US006965742B2

(12) United States Patent
Miyamoto et al.

(10) Patent No.: US 6,965,742 B2
(45) Date of Patent: Nov. 15, 2005

(54) IMAGE FORMING APPARATUS

(75) Inventors: Toshio Miyamoto, Shizuoka (JP); Masahiko Suzumi, Shizuoka (JP); Koji Nihonyanagi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 10/698,529

(22) Filed: Nov. 3, 2003

(65) Prior Publication Data

US 2004/0091277 A1 May 13, 2004

(30) Foreign Application Priority Data

Nov. 8, 2002 (JP) ..... 2002-326182

(51) Int. Cl.[7] ..... G03G 15/16; G03G 15/02

(52) U.S. Cl. ..... 399/50; 399/66; 399/301

(58) Field of Search ..... 399/45, 50, 66, 399/299, 301, 310, 313, 314, 315

(56) References Cited

U.S. PATENT DOCUMENTS

| | | | | |
|---|---|---|---|---|
| 5,410,393 | A | 4/1995 | Watanabe | 355/273 |
| 5,519,475 | A | 5/1996 | Miyamoto et al. | |
| 5,862,435 | A | 1/1999 | Suzumi et al. | 399/68 |
| 5,991,555 | A | 11/1999 | Suzumi et al. | 399/18 |
| 6,085,058 | A | 7/2000 | Goto et al. | 399/313 |
| 6,477,348 | B2 | 11/2002 | Miyamoto et al. | 399/299 |
| 6,493,521 | B2 | 12/2002 | Miyamoto et al. | 399/44 |
| 6,654,570 | B2 * | 11/2003 | Kato | 399/66 |
| 6,731,890 | B1 * | 5/2004 | Rakov et al. | 399/66 |
| 2002/0118977 | A1 | 8/2002 | Hasegawa et al. | 399/69 |
| 2003/0118363 | A1 | 6/2003 | Izawa et al. | 399/69 |

FOREIGN PATENT DOCUMENTS

| | | |
|---|---|---|
| JP | 5-224541 | 9/1993 |
| JP | 8-194425 | 7/1996 |
| JP | 9-80871 | 3/1997 |

OTHER PUBLICATIONS

Partial translation of JP 5–224541.

* cited by examiner

*Primary Examiner*—Hoang Ngo
(74) *Attorney, Agent, or Firm*—Fitzpatrick, Cella, Harper & Scinto

(57) ABSTRACT

An image forming apparatus which can prevent the electric discharge when the trailing edge of a recording material passes a transferring position, and yet can stabilize the surface potential of a photosensitive drum. A controller changes a transfer bias voltage Vt during the supply of paper to 0 V before the trailing edge of recording paper arrives at a transferring nip part, changes it to a transfer bias voltage $V_0$ during the non-supply of paper after the trailing edge of the recording paper has passed the transferring nip part, and changes a charging bias voltage to a charging bias voltage smaller than a normal charging bias voltage when an area on the photosensitive drum to which 0 V has been applied passes a charging nip portion. The transfer bias voltage $V_0$ during the non-supply of paper is smaller than the transfer bias voltage Vt during the supply of paper.

9 Claims, 18 Drawing Sheets

THE INVENTION

COMPARATIVE CONVENTIONAL EXAMPLE

COMPARATIVE CONVENTIONAL EXAMPLE

IMAGE FORMING APPARATUS

BACKGROUND OF THE INVENTION

1. Field of the Invention

The invention relates to an image forming apparatus.

2. Description of Related Art

FIG. 21 of the accompanying drawings schematically shows the construction of an electrophotographic type laser beam printer which is an example of a conventional image forming apparatus.

In this example, a drum-shaped electrophotographic photosensitive member, i.e., a photosensitive drum 1, as an image bearing member is rotated at a predetermined speed in the direction of arrow. The surface of the photosensitive drum 1 is charged by a charging roller 2 as charging means for effecting primary charging so that the surface potential thereof may become uniform. On the uniformly charged photosensitive drum 1, a laser beam 3 is ON/OFF-controlled by exposure means on the basis of inputted image data and is scanned, whereby an electrostatic latent image is formed on the photosensitive drum. The electrostatic latent image formed on the photosensitive drum 1 is visualized as a toner image by the developer of developing means 4.

On the other hand, a sheet feeding cassette 26 stacks thereon recording materials, usually recording sheets P which are recording mediums, and feeds a recording sheet P to the location of registration rollers 24 by the driving of a sheet feeding roller 22.

The toner image visualized on the photosensitive drum 1 is transferred to the recording sheet P under the action of a transferring roller 5 as transferring means. Any toner residual on the photosensitive drum 1 is removed by cleaning means 7, and the photosensitive drum 1 is used for the next image forming.

The photosensitive drum 1, the primary charging means 2, the developing means 4 and the cleaning means 7 are integrally made into a cartridge which can be easily interchanged with respect to an apparatus main body 100 by a user.

The toner image transferred to the recording sheet P is heated and pressurized by fixing rollers 6 (fixing means) and is fixed on the recording sheet P. The recording sheet P having had the toner image thereon fixed is discharged onto a sheet discharge tray or the like.

The above-described conventional image forming apparatus, however, has suffered from a problem as shown below.

That is, in an image forming process, the recording sheet P is transported to a transferring region at which the transferring roller 5 is provided, and the toner image formed on the photosensitive drum 1 is transferred to the recording sheet P. When the transfer of the toner image is finished up to the trailing edge of the recording sheet P, the recording sheet P is separated and transported from the photosensitive drum 1.

When the trailing edge of the sheet is separated from the photosensitive drum 1, a transfer bias is applied to the transferring roller 5 and therefore, stripping discharge occurs between the photosensitive drum 1 and the trailing edge of the recording sheet. If for example, a plus voltage is applied as the transfer bias, the memory of a discharge trace will remain on the photosensitive drum 1 due to the stripping discharge, and as shown in FIG. 7 of the accompanying drawings, a trace will be produced as a lateral black line on the next page.

According to the result of our studies and experiments, to prevent such black line, it has been effective to switch off the transfer bias before the trailing edge of the sheet separates from the photosensitive drum 1. Thereby, the stripping discharge itself occurring when the recording sheet P separates from the photosensitive drum has been mitigated and the black line has been improved.

By this countermeasure, however, the photosensitive drum 1 does not receive the plus voltage of the transfer bias within a range in which the transfer bias has been rendered off and thus, only that portion does not receive a transfer memory. Therefore, only that portion of the photosensitive drum 1 which has not received the transfer voltage becomes somewhat high in the surface potential thereof though it is generally of the order of −500 to −600 volts. Thereby, as shown in FIG. 8 of the accompanying drawings, there has arisen a new problem that the density of the next page becomes low only at the pertinent location. This problem is particularly remarkable when an image on a page on which an image is to be formed next time is of a half tone.

SUMMARY OF THE INVENTION

The present invention has been made in view of the above-noted point and an object thereof is to provide an improved image forming apparatus.

A further object of the present invention is to provide an image forming apparatus comprising an image bearing member, a charging portion for applying a first charging voltage of a predetermined polarity to a charging member to thereby charge the image bearing member to predetermined potential at a charging position, an exposing portion for exposing the image bearing member to light to thereby form an electrostatic latent image thereon, a developing portion for developing the electrostatic latent image on the image bearing member with a toner to thereby form a toner image, a transferring portion for applying a first transfer voltage of a polarity opposite to the predetermined polarity to a transferring member to thereby transfer the toner image on the image bearing member to a recording material at a transferring position, and a controlling portion for controlling the charging voltage applied to the charging member by the charging portion and the transfer voltage applied to the transferring member by the transferring portion, wherein the controlling portion changes the first transfer voltage to a second transfer voltage before the trailing edge of the recording material arrives at the transferring position, and changes it to a third transfer voltage after the trailing edge of the recording material has passed the transferring position, and changes the first charging voltage to a second charging voltage smaller than the first charging voltage when an area on the image bearing member to which the second transfer voltage has been applied passes the charging position, and the difference between the second transfer voltage and the third transfer voltage is smaller than the difference between the second transfer voltage and the first transfer voltage.

Still a further object of the present invention is to provide an image forming apparatus comprising an image bearing member, a charging portion for charging the image bearing member to predetermined potential, an exposing portion for exposing the image bearing member to light to thereby form an electrostatic latent image thereon, a developing portion for applying a first developing voltage of a predetermined polarity to a developing member to thereby develop the electrostatic latent image on the image bearing member with a toner at a developing position and form a toner image, a transferring portion for applying a first transfer voltage of a polarity opposite to the predetermined polarity to a transferring member to thereby transfer the toner image on the image bearing member to a recording material at a transferring position, and a controlling portion for controlling a charging voltage applied to a charging member by the charging portion and the transfer voltage applied to the transferring member by the transferring portion, wherein the controlling portion changes the first transfer voltage to a second transfer voltage before the trailing edge of a recording material arrives at a transferring position, and changes it to a third transfer voltage after the trailing edge of the recording material has passed the transferring position, and changes the first developing voltage to a second developing voltage greater than the first developing voltage when an area on the image bearing member to which the second transfer voltage has been applied passes the developing position, and the difference between the second transfer voltage and the third transfer voltage is smaller than the difference between the second transfer voltage and the first transfer voltage.

These and other objects, features and advantages of the present invention will become more apparent upon reading of the following detailed description along with the accompanying drawings.

DETAILED DESCRIPTION OF THE PREFERRED EMBODIMENTS

Image forming apparatuses according to the present invention will hereinafter be described in greater detail with reference to the drawings.

<First Embodiment>

Figure 1:
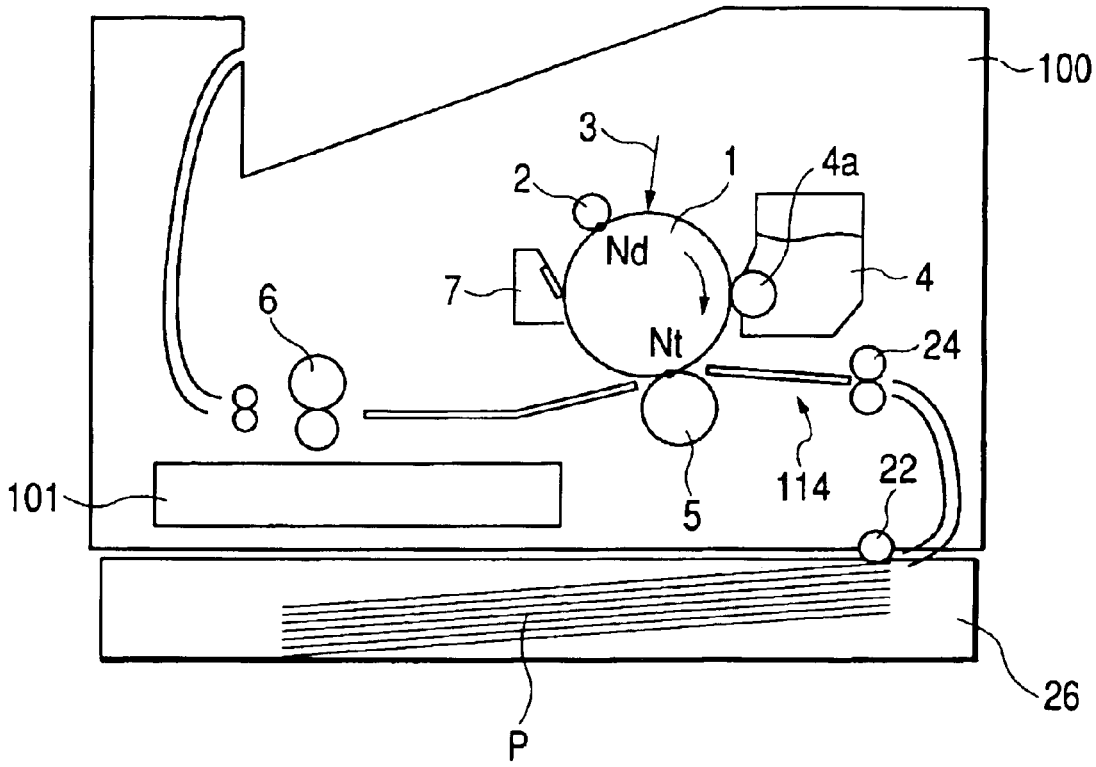
FIG. 1 schematically shows the construction of an image forming apparatus.
Figure 21:
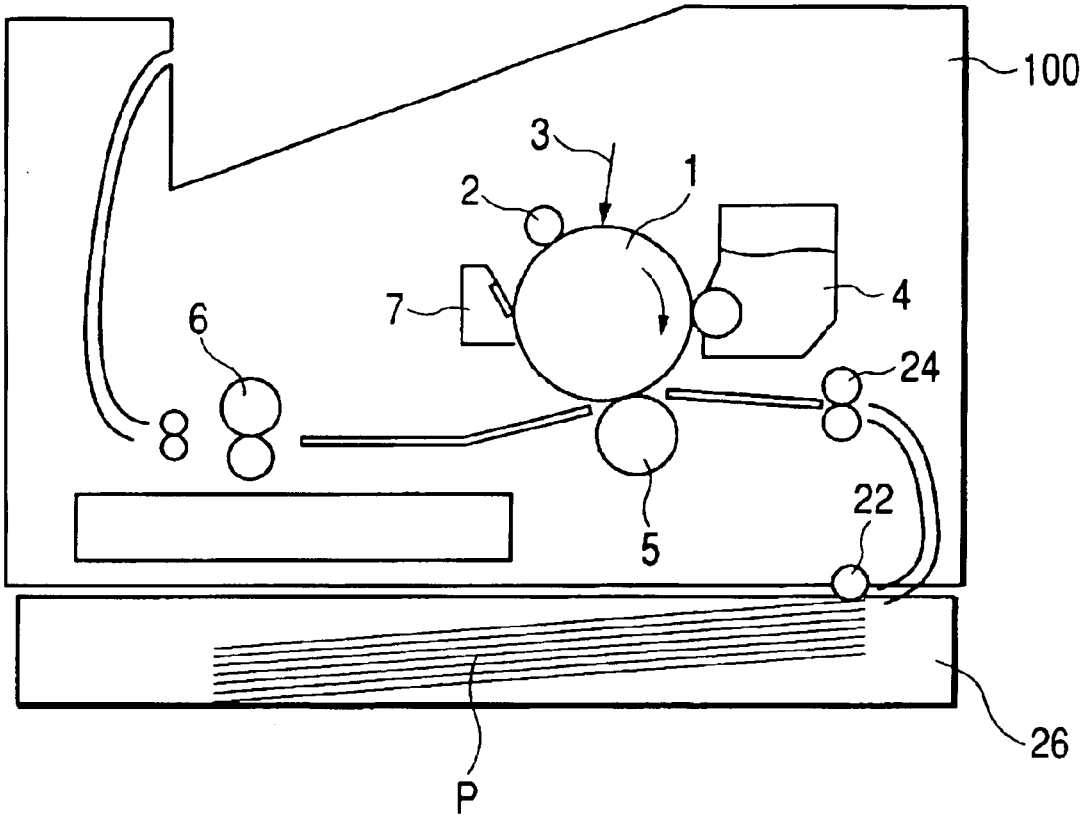
FIG. 21 schematically shows the construction of a conventional image forming apparatus.

FIG. 1 schematically shows the construction of an electrophotographic type laser beam printer which is an embodiment of the image forming apparatus of the present invention. The laser beam printer according to the first embodiment is similar in construction to the aforedescribed laser beam printer shown in FIG. 21, and members similar in construction and function to those in the aforedescribed laser beam printer are given similar reference numerals and need not be described in detail.

In the first embodiment, a drum-shaped electrophotographic photosensitive member, i.e., a photosensitive drum 1, as an image bearing member is comprised of a cylinder-shaped substrate of aluminum, nickel or the like and a photosensitive material such as OPC formed thereon.

First, the surface of the photosensitive drum 1 is uniformly charged by a charging roller 2 as charging means to which as charging bias (voltage) is applied. The charging bias applied to the charging roller 2 is supplied from a high voltage source (not shown), and is a voltage comprising a DC voltage and an AC voltage superimposed upon each other. The DC voltage applied to the charging roller 2 by the high voltage source is usually −620 volts. Also, the AC voltage applied to the charging roller 2 by the high voltage source is a voltage of sine waveform having a frequency of 500 to 1000 Hz and a voltage amplitude (peak-to-peak voltage) of 1600 to 2000V.

Next, in conformity with image information, a laser beam 3 is scanned from exposure means to expose the photosensitive drum 1 thereto, and an electrostatic latent image is formed on the uniformly charged photosensitive drum 1. This electrostatic latent image is developed and visualized by developing means 4 by a developing bias being applied thereto. As the developing method, use is made of a jumping developing method, a two-component developing method or the like, and these are often used in a combination of image exposure and reversal developing.

Recording paper P as a recording material is taken out of a paper feeding cassette 26 by a paper feeding roller 22, and is fed to registration rollers 24. The recording paper P is supplied to a transfer nip part Nt formed by the photosensitive drum 1 and a transferring roller 5 by the registration rollers 24 in synchronism with the toner image formed on the surface of the photosensitive drum 1. A presence/absence of paper detecting sensor,. i.e., a top sensor 114, detects the leading edge of the fed recording paper P. At the transfer nip part Nt, the toner image on the photosensitive drum 1 is transferred to the recording paper P by the action of a transfer bias applied to the transferring roller by a voltage source (not shown).

The recording paper P bearing the toner image thereon is transported to fixing means 6, and is heated and pressurized by the nip part of the fixing means 6, whereby the toner image thereon is fixed on the recording paper P and becomes a permanent image, and the recording paper P is discharged out of the image forming apparatus. On the other hand, any untransferred residual toner residual on the photosensitive drum 1 after the transfer is removed from the surface of the photosensitive drum 1 by cleaning means 7.

The printer according to the first embodiment had the capacity of A4 size paper 24 ppm (24 sheets printed per minute), and the process speed thereof was about 150 mm/sec. and the resolution thereof was 600 dpi.

Figure 2:
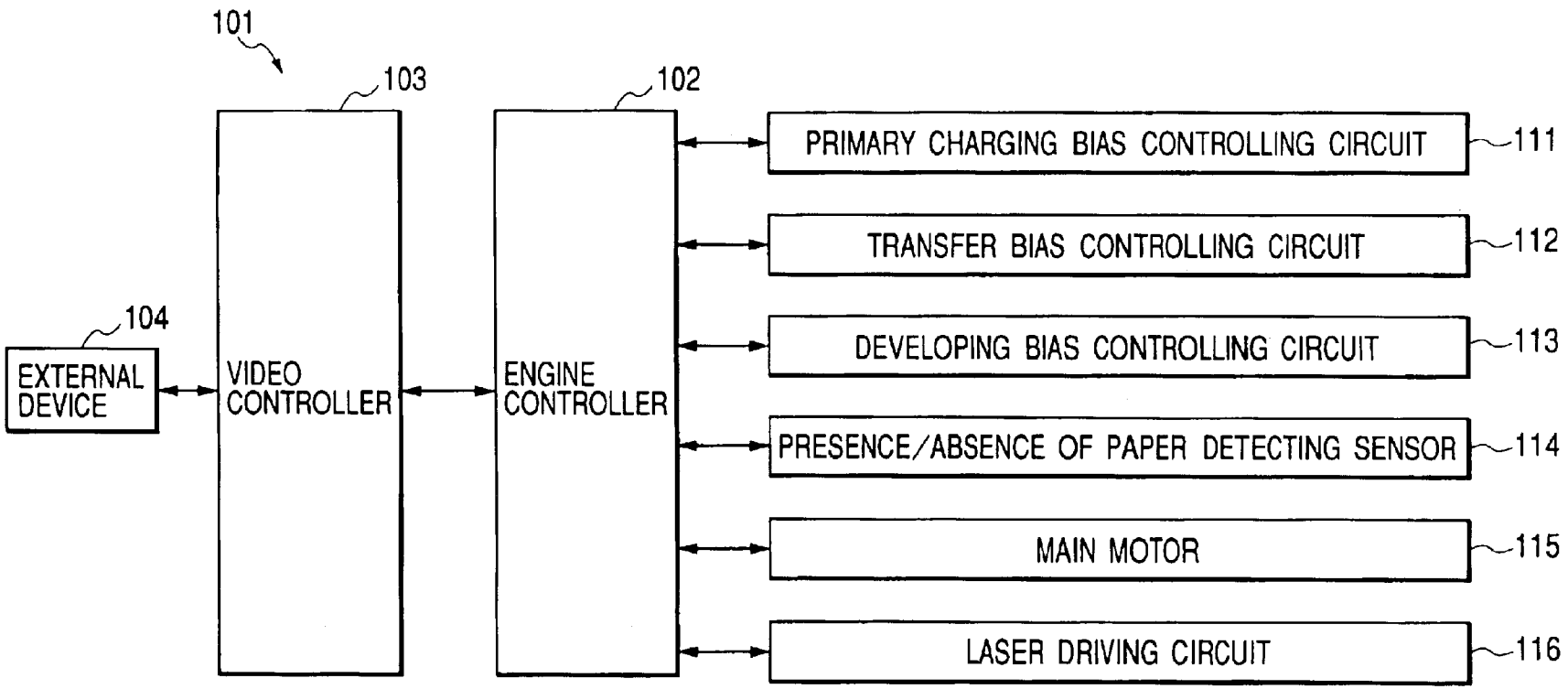
FIG. 2 is a block diagram showing the construction of the image forming apparatus.

FIG. 2 is a control block diagram showing an example of the construction of the control means 101 of the printer of the above-described construction.

In the present embodiment, a printer apparatus main body 100 is provided with the control means 101 which has an engine controller 102 and a video controller 103. The engine controller 102 is electrically connected to a primary charging bias controlling circuit 111 for controlling a charging bias applied to the charging means 2, a transfer bias controlling circuit 112 for controlling a transfer bias applied to the transferring means 5, a developing bias controlling circuit 113 for controlling a developing bias applied to the developing means 4 (i.e., a developing roller 4*a* as a developer carrying member), a presence/absence of paper detecting sensor 114 for detecting the leading edge of paper, a main motor 115, a laser driving circuit 116, etc., effects the transmission and reception of a signal, and controls the driving and process conditions or the like of the apparatus for image forming. Also, the video controller 103 is connected to an external device 104 which is a host computer or the like, and receives a signal from the external device 104 and forms a video signal, and transmits it to the engine controller 102.

The present invention will now be described with reference to FIGS. 3 and 4.

Figure 3:
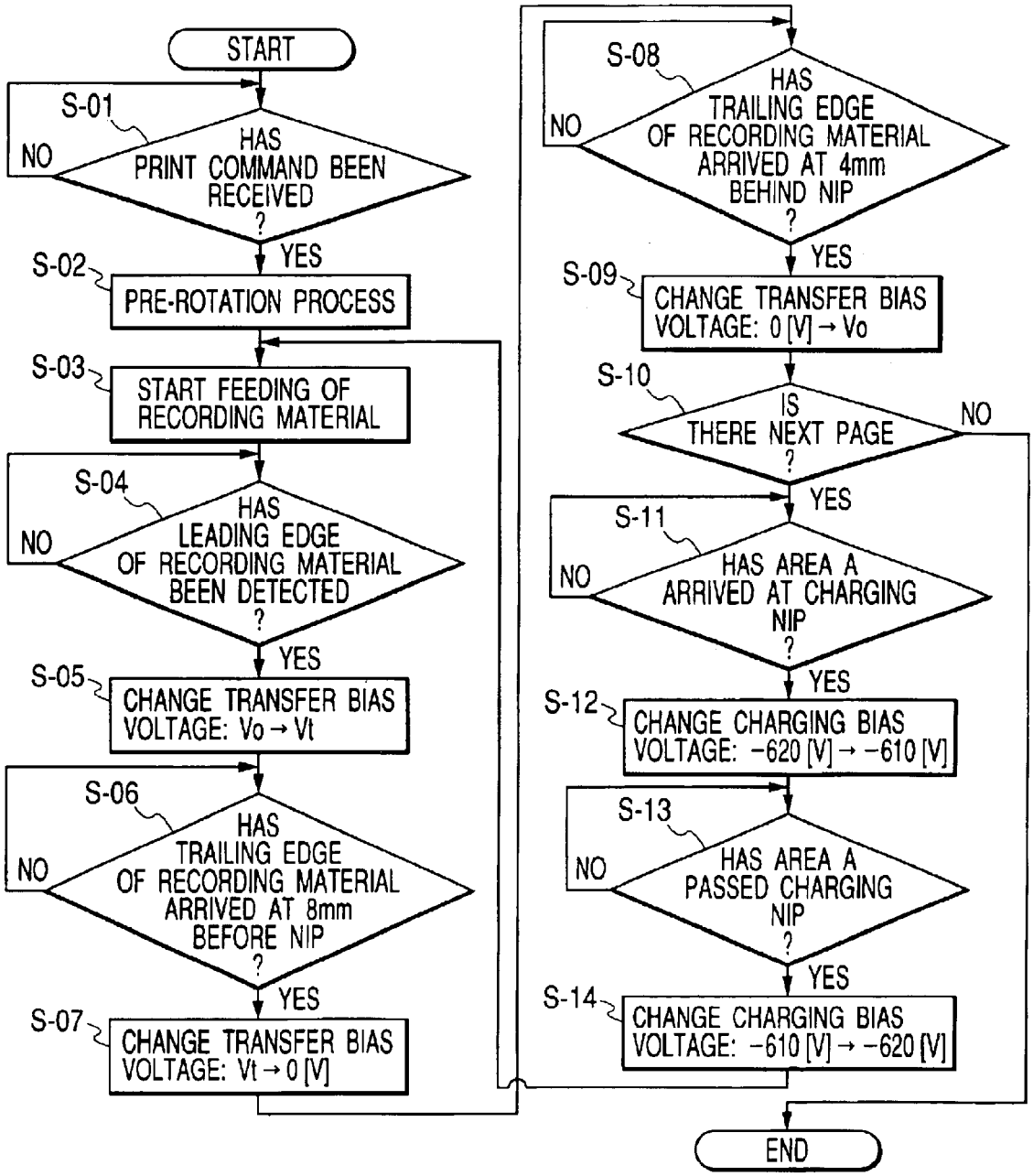
FIG. 3 is a flow chart for illustrating the operation mode when halftone images are printed on two sheets on end in accordance with a first embodiment.
Figure 4:
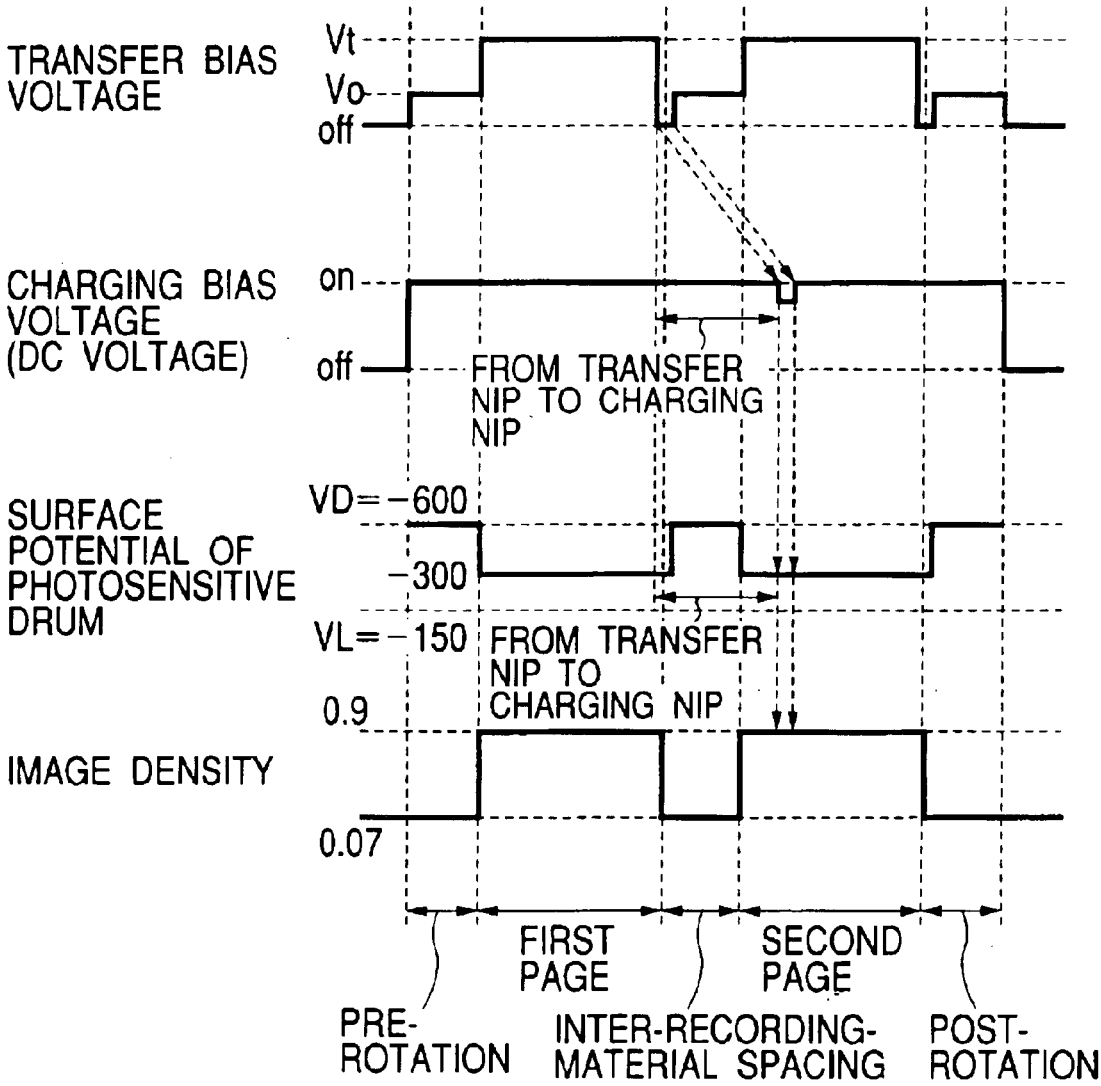
FIG. 4 is a timing chart showing a transfer bias, a charging DC voltage, photosensitive member potential and printed image density when halftone images are printed on two sheets on end.

FIG. 3 is a flow chart for illustrating the operation mode when halftone images are printed on two sheets on end in accordance with the present embodiment, and FIG. 4 is a timing chart showing a transfer bias voltage, a charging bias voltage (charging DC voltage), photosensitive member potential and printed image density at that time. In the present embodiment, the photosensitive member is a cylindrical drum-shaped photosensitive drum 1, and is subjected to the steps of charging exposing, developing transferring and cleaning with the rotation thereof and therefore, the timing chart has some time differences at the respective steps, but here description will be made with the time differences neglected for simplicity.

The operations in the flow chart of FIG. 3 are operations executed by the video controller 103 and the engine controller 102 the control means 101 has. Particularly, the engine controller 102 transmits a control signal to the transfer bias controlling circuit 112 to thereby control the transfer bias voltage, and transmits a control signal to the primary charging bias controlling circuit 111 to thereby control the charging bias voltage.

According to the present embodiment, when print is started and a print command is received by the control means 101 of the apparatus main body, a pre-rotation process operation for starting the print is started (S-01 and S-02).

Figure 5:
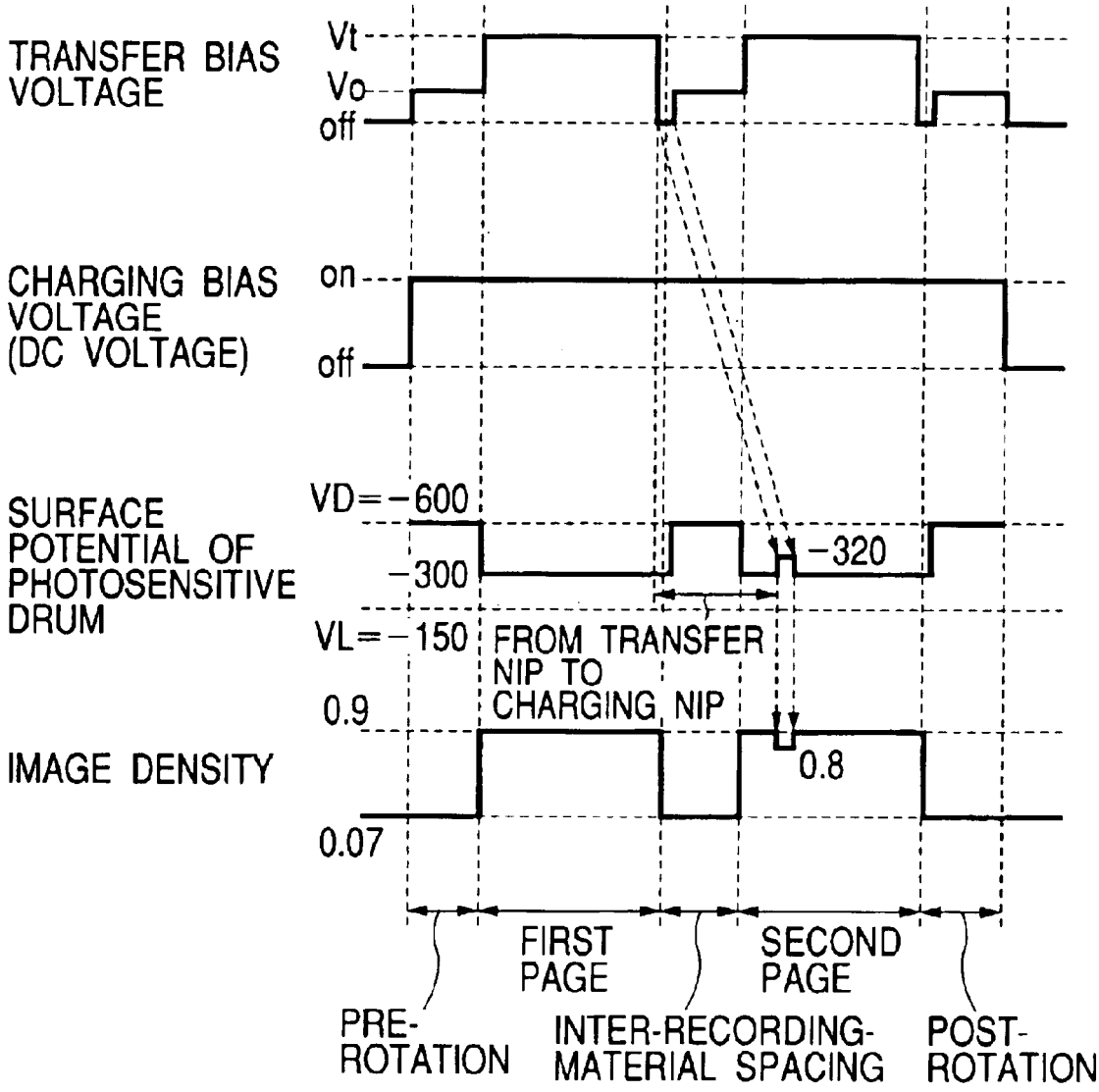
FIG. 5 is a timing chart showing a transfer bias, a charging DC voltage, photosensitive member potential and printed image density when in a comparative conventional example, halftone images are printed on two sheets on end.

As will be understood from FIG. 5, at the pre-rotation process, the transfer bias voltage is changed over from 0 V (zero volt) to a transfer bias voltage $V_0$ during the non-supply of paper. The transfer bias controlling circuit 112 serves to apply the transfer bias voltage $V_0$ during the non-supply of paper on the basis of a value detected by a transfer current detecting portion (not shown) so that a transfer current amount flowing with the transfer bias voltage $V_0$ during the non-supply of paper applied may become constant, and roughly calculate the resistance value of the transferring roller from the transfer bias voltage $V_0$ during the non-supply of paper to thereby determine a transfer bias voltage Vt during the supply of paper.

Also, the charging bias voltage (DC voltage) is rendered on to charge the surface of the photosensitive drum when pre-rotation is started. In the present embodiment, the charging DC voltage was −620 volts in order to obtain photosensitive member charging potential of −600 volts. The photosensitive member potential becomes predetermined dark potential VD=−600 volts by the on of charging. When the printing of the first page is started, the charging DC voltage remains on and is constant, but the photosensitive member potential becomes about −300 volts because the photosensitive member is subjected to exposure.

On the other hand, when the pre-rotation process is terminated, the recording paper P is taken out of the paper feeding cassette 26 by the paper feeding roller 22 and is fed to the registration rollers 24 (S-03). When the leading edge of the recording paper is detected by a top sensor 8(S-04), the transfer bias controlling circuit 112 changes over the transfer bias voltage from the transfer bias voltage $V_0$ during the non-supply of paper to the transfer bias voltage Vt during the supply of paper in order to transfer the toner image developed on the photosensitive drum 1 to the recording paper P(S-05). Both of the transfer bias voltages are voltages of the positive polarity, but the transfer voltage Vt during the supply of paper (first transfer voltage) is higher in voltage value (greater in the absolute value of voltage) than the transfer voltage $V_0$ during the non-supply of paper (third transfer voltage).

In the first embodiment, the transfer bias controlling circuit 112 controlled the transfer voltage $V_0$ during the non-supply so that during the non-supply of paper, a transfer current of about 3 $\mu$A (microamperes) might flow to the photosensitive drum 1 through the transferring roller 5. The transfer bias voltage applied to the transferring roller 5 at this time is of the order of +700 V (volts).

On the other hand, the transfer bias controlling circuit 112 controls the transfer bias voltage during the supply of paper so as to assume a value roughly calculated from the transfer bias voltage $V_0$ (third transfer voltage) applied to the transferring roller 5 during the non-supply of paper. The transfer bias voltage Vt (first transfer voltage) during the supply of paper applied to the transferring roller 5 differs depending on the resistance value of the transferring roller 5 changed by the environment under which the printer apparatus main body 100 is placed, but is set so that under any environment, the transfer current flowing to the transferring roller 5 may be about 6 μA.

It is for the following two reasons that the transfer bias controlling circuit 112 controls so that during the non-supply of paper, a transfer current of about 3 μA may flow to the photosensitive drum 1.

A first reason will first be described.

While a transfer current of about 6 μA is set so as to flow the transferring roller 5 when the transfer bias voltage Vt during the supply of paper (first transfer voltage) is applied to the transferring roller 5, not all of this transfer current of about 6 μA flows to the photosensitive drum 1, but some of the current flows to except the photosensitive drum 1 through the recording paper P. For example, some of the current flows to an ante-transfer guide (not shown) for guiding the transport of the recording paper P so that the recording paper P may be transported to a transferring nip part Nt, and to the fixing roller 6 after the leading edge of the recording paper P has arrived at it.

When the transfer bias controlling circuit 112 controls the transfer bias voltage applied to the transferring roller 5 so that a transfer current of about 6 μA may flow to the transferring roller 5, the result is that a current of about 3 μA flows to the photosensitive drum 1.

Thus, during the supply of paper, a current of about 3 μA flows to the photosensitive drum 1, but to make the surface potential of the photosensitive drum 1 constant, it is necessary to make design such that even during the non-supply of paper, the current flowing to the photosensitive drum 1 becomes about 3 μA. This is due to the fact that the magnitude of the current value flowing to the photosensitive drum 1 affects the surface potential of the photosensitive drum 1.

Accordingly, the transfer bias controlling circuit 112 controls the transfer bias voltage applied to the transferring roller 5 so that a current of about 3 μA may flow to the photosensitive drum 1 during the non-supply of paper.

A second reason will now be described.

The toner for developing from the developing roller 4*a* to the photosensitive drum 1 is usually a toner of the negative polarity, but a toner bearing the positive polarity also exists due to the friction among toner particles. If during the non-supply of paper when the recording material does not exist at the transferring nip part Nt, the application of the transfer voltage to be applied to the transferring roller 5 is stopped to thereby bring about 0 V (second transfer voltage), the potential difference from the toner of the positive polarity may become small and the toner of the positive polarity may shift to the transferring roller 5 in some cases. If such shift occurs, there will arise the problem that the back of the recording material supplied next is stained. By controlling so that during the non-supply of paper, a transfer current of about 3 μA may flow to the photosensitive drum 1, a potential difference is provided between the toner of the positive polarity and the transferring roller 5 to thereby make it difficult for the toner of the positive polarity to shift to the transferring roller 5.

In order to prevent the photosensitive member memory caused by stripping discharge occurring when at the trailing edge of the first page, the trailing edge of the recording paper P is stripped off from the photosensitive drum 1, the transfer bias voltage Vt during the supply of paper is once stopped to thereby bring about 0 V when a portion of the paper which is about 8mm before the trailing edge of the paper passes the transferring nip part Nt (S-06 and S-07), and after the trailing edge of the recording paper P has passed the transferring nip part Nt by 4 mm, the transfer bias voltage $V_0$ during the non-supply of paper is applied (S-08 and S-09).

Here, an area on the photosensitive drum 1 which has passed the-transferring roller 5 when at the aforedescribed steps S-07 to S-09, the transfer bias voltage has been stopped to thereby bring about 0V is called the "area A". In the present embodiment, judgement as to at what position the trailing edge of the recording paper P is, and at what position the "area A" is designed such that the engine controller 102 has a counter for counting time, and the position of the recording paper and the position of the "area A" are judged from the time counted by the counter after the leading edge of the paper is detected by the top sensor 8.

As will be understood from FIG. 4, in an area corresponding to the spacing between the continuously transported recording materials P (inter-recording-material spacing), the transfer bias voltage is maintained at the transfer voltage $V_0$ during the non-supply of paper, and the charging DC voltage is on and constant. The surface potential of the photosensitive drum 1 is dark potential VD because the photosensitive drum is not subjected to exposure in the inter-recording-material spacing.

The control means 101 subsequently judges about the necessity or unnecessariness of the print of the second page (S-10), and if the print of the second page is unnecessary, the image forming operation is terminated. If the print is necessary, shift is made to the printing operation for the second page.

Regarding the print of the second page, like that of the first page, the charging bias voltage (DC voltage) remains on and the surface potential of the photosensitive drum 1 is of the order of −300 volts because the photosensitive drum is subjected to exposure for a halftone image.

FIG. 5 is a timing chart showing a transfer bias, a charging bias voltage, the surface potential of the photosensitive drum and printed image density in a comparative conventional example similar to those in the present embodiment shown in FIG. 4. In the comparative conventional example, the charging bias voltage (DC voltage) is on and is regarded as being constant.

As shown in FIG. 5, in the comparative conventional example, the surface potential of a pertinent position on the photosensitive drum 1, i.e., the area A, in a portion wherein the transfer bias voltage is rendered off when the trailing edge of the recording paper P for the first page passes the transferring nip part Nt is −320 volts and is lower than the surface potential −300 volts of the other portions. Therefore, image density is low in halftone density, i.e., 0.8 (a value by a Macbeth density meter) in this pertinent portion only. On the other hand, the halftone density in the other portions was 0.9.

As described above, in the comparative conventional example, a density difference in halftone occurs on the second and subsequent continuously printed sheets. That is, there was seen the tendency of halftone image density becoming low in the pertinent portion (area A).

Figure 8:
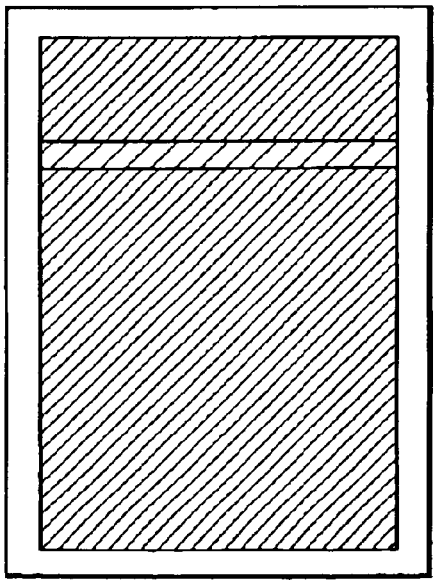
FIG. 8 shows a printed image in the comparative conventional example.

As shown in FIG. 8, in the comparative conventional example, a portion low in density occurs to the halftone. This is just because the transfer bias voltage was off when the pertinent position (area A) of the photosensitive drum 1 was at the transferring nip part Nt.

Accordingly, in the present embodiment, during the print of the second page, when the position in which the transfer bias voltage was rendered off, i.e., the above-described area A, has arrived at the charging nip part Nd whereat the primary charging roller 2 is disposed, the charging bias voltage (DC voltage) for the second page is heightened in voltage value, i.e., from normal −620 volts to −610 volts, (is made smaller in the absolute value of the voltage)(S-11 and S-12). When the area A passes the charging nip part Nd, the charging bias voltage is restored from −610 volts to −620 volts (S-13 and S-14). Thereby, the photosensitive member potential after the exposure of the second page can be rendered constant at −300 volts, and could be rendered constant at image density of 0.9.

Thereafter, the aforedescribed step S-03 and subsequent steps are executed to thereby continue image forming.

Figure 6:
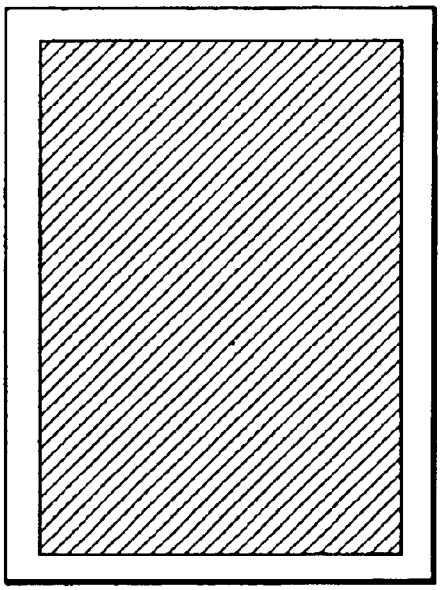
FIG. 6 shows a printed image.
Figure 7:
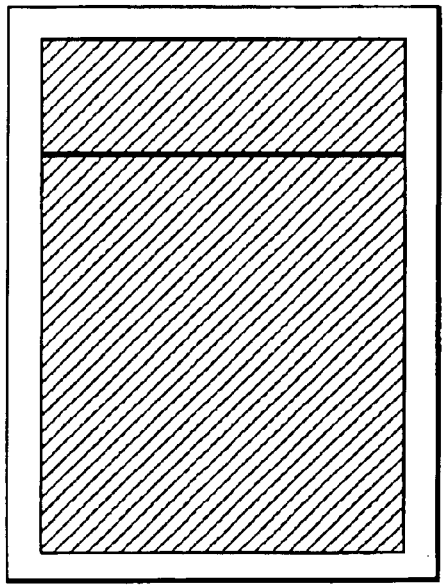
FIG. 7 shows a printed image in the comparative conventional example.

In the present invention, as shown in FIG. 6, there was obtained a uniform halftone. Moreover, the transfer bias was rendered off at the trailing edge of the paper of each page and therefore, the black line of the trailing edge memory of paper as shown in FIG. 7 did not occur.

<Second Embodiment>

A second embodiment of the present invention will now be described. The construction of an image forming apparatus according to the present invention is similar to that of the image forming apparatus according to the first embodiment shown in FIG. 1.

The present embodiment is characterized in that a developing bias voltage (DC voltage) is controlled to prevent the photosensitive drum memory caused by the transfer bias voltage being rendered off when the trailing edge of the recording paper P for the first page passes the transferring nip part Nt.

Figure 9:
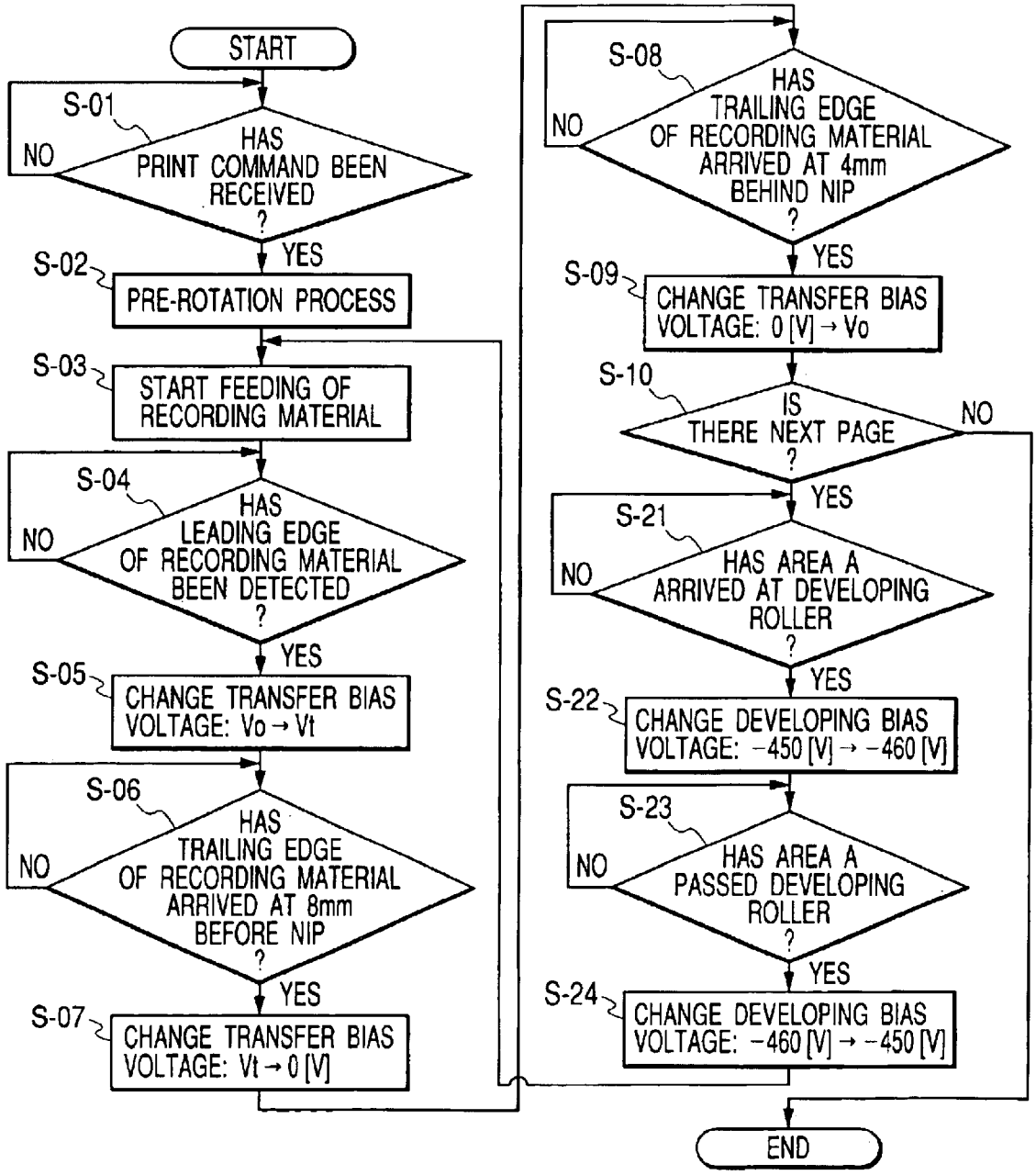
FIG. 9 is a flow chart for illustrating the operation mode when halftone images are printed on two sheets on end in accordance with a second embodiment.
Figure 10:
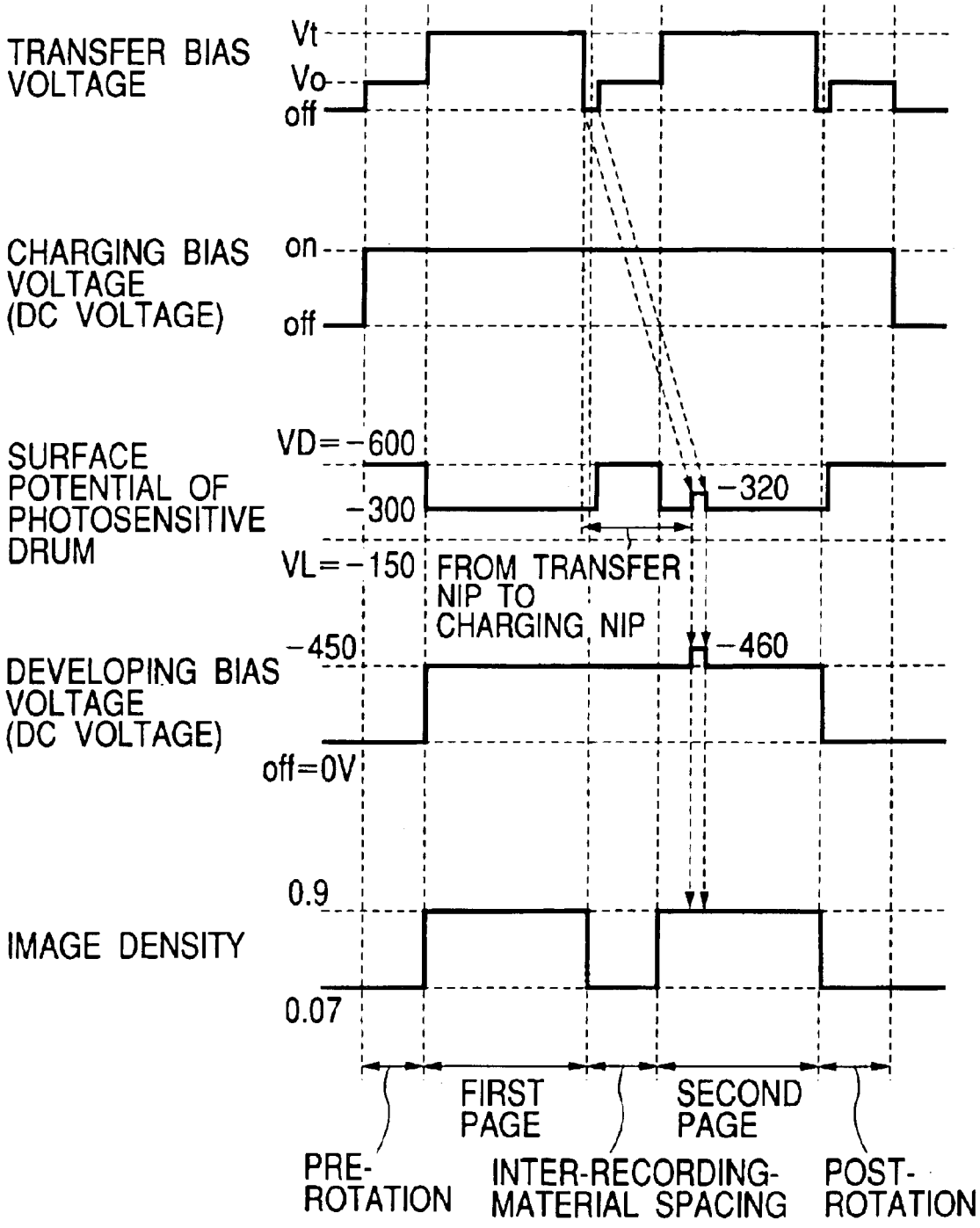
FIG. 10 is a timing chart showing a transfer bias, a charging DC voltage, photosensitive member potential and printed image density when halftone images are printed on two sheets on end in accordance with the second embodiment.

Reference is now had to FIGS. 9 and 10 to describe the present embodiment.

FIG. 9, is a flow chart for illustrating the operation mode when as in the first embodiment, halftone images are printed on two sheets on end in accordance with the present embodiment, and FIG. 10 is a timing chart showing a transfer bias voltage, a charging bias voltage, the surface potential of the photosensitive drum, a developing bias voltage (developing DC voltage) and printed image density at that time. Again in the present embodiment, the photosensitive member is a cylindrical drum-shaped photosensitive drum 1, and is subjected to the steps of charging, exposing, developing, transferring and cleaning with the rotation thereof and therefore, the timing chart has some time differences at the respective steps, but here description will be made with the time differences neglected for simplicity.

The operations in the flow chart of FIG. 9 are operations executed by the video controller 103 and the engine controller 102 the control means 101 has. Particularly, the engine controller 102 transmits a control signal to the transfer bias controlling circuit 112 to thereby control the transfer bias voltage, and transmits a control signal to the primary charging bias controlling circuit 111 to thereby control the charging bias voltage.

According to the present embodiment, when print is started and a print command is received by the control means 101 of the apparatus main body, a pre-rotation process operation for starting the print is started (S-01 and S-02).

As will be understood from FIG. 10, when in the pre-rotation process, the pre-rotation operation for starting the print is started, the transfer bias control circuit 112 changes over the transfer bias voltage from 0 V in an off state to the transfer bias voltage $V_0$ during the non-supply of paper. The transfer bias control circuit 112 serves to apply the transfer bias voltage $V_0$ during the non-supply of paper on the basis of a value detected by a transfer current detecting portion (not shown) so that a transfer current amount flowing with the transfer bias voltage $V_0$ during the non-supply of paper applied may become constant, and roughly calculate the resistance value of the transferring roller from the transfer bias voltage $V_0$ during the non-supply of paper to thereby determine the transfer bias voltage Vt during the supply of paper.

Also, the charging bias voltage (DC voltage) is rendered on to charge the surface of photosensitive drum to predetermined potential when the pre-rotation is started. In the present embodiment, the charging DC voltage was −620 volts in order to obtain photosensitive member charging potential of −600 volts. The photosensitive member potential becomes predetermined dark potential VD=−600 volts by the charging being on. When the print of the first page is started, the charging DC voltage remains on and is constant, but the photosensitive member potential becomes about −300 volts because the photosensitive member is subjected to exposure.

Also, with the start of the pre-rotation, a developing DC voltage is also applied to the developing roller 4*a* of the developing means 4. In the present embodiment, the developing bias was −450 volts.

On the other hand, when the pre-rotation process is terminated, the recording paper P is taken out of the paper feeding cassette 26 by the paper feeding roller 22, and is fed to the registration rollers 24 (S-03). When the leading edge of the recording paper is detected by the top sensor 8 (S-04), the transfer bias controlling circuit 112 changes over the transfer bias voltage from the transfer bias voltage $V_0$ during the non-supply of paper to the transfer bias voltage Vt during the supply of paper (S-05).

Both of the transfer bias voltages are voltages of the positive polarity, but the transfer voltage Vt during the supply of paper (first transfer voltage) is greater in absolute value than the transfer voltage $V_0$ during the non-supply of paper (third transfer voltage).

Again in the present embodiment, the transfer bias control circuit 112 controlled so as to let a current of about 3 microamperes flow to the photosensitive member through the transferring roller 5 during the supply of paper. The voltage at this time was of the order of nearly +700 volts. During the supply of paper, it controls the transfer bias voltage so as to assume a value converted from the transfer bias voltage $V_0$ (third transfer voltage) applied to the transferring roller 5 during the non-supply of paper. The transfer bias voltage Vt during the supply of paper (first transfer voltage) applied to the transferring roller 5 differs depending on the resistance value of the transferring roller 5 changed by the environment under which the printer apparatus main body 100 is placed, but it is set so that under any environment, the transfer current flowing to the transferring roller 5 may be about 6 microamperes.

In order to prevent photosensitive member memory caused by discharge occurring when the trailing edge of the recording paper P for the first page separates from the photosensitive drum 1, the transfer bias voltage is once rendered off and is made into 0V when that portion of the recording paper P which is about 8 mm before the trailing edge of the recording paper P passes the transferring nip part Nt, and the transfer bias voltage $V_0$ during the non-supply of paper is rendered on after the trailing edge of the recording paper P has passed the transferring nip part Nt by 4 mm (S-08 and S-09).

Here, at the afore described steps S-07 to S-09, an area on the photosensitive drum which has passed the transferring roller 5 when the transfer bias voltage has been stopped and made into 0 V is defined as the "area A".

Also, design is made such that regarding judgment as to at what position the trailing edge of the recording paper P and to at what position the "area A" is, as in the first embodiment, the engine controller 102 has a counter for counting time, and the position of the recording paper and the position of the "area A" are judged from the time counted by the counter after the leading edge of the paper has been detected by the top sensor 8.

As will be understood from FIG. 10, in an area corresponding to the inter-recording-material spacing, the transfer bias voltage is maintained at the transfer voltage $V_0$ during the non-supply of paper, and the charging DC voltage is on and is constant. The surface potential of the photosensitive drum 1 is dark potential VD because the photosensitive drum is not subjected exposure in the inter-recording-material spacing.

The control means 101 subsequently judges about the necessity or unnecessariness of the print of the second page (S-10), and if the print is unnecessary, the image forming operation is terminated. If the print is necessary, shift is made to the printing operation for the second page.

Regarding the print of the second page, like that of the first page, the charging bias voltage (DC voltage) remains on and the surface potential of the photosensitive drum 1 is of the order of −300 volts because the photosensitive drum is subjected to exposure for a halftone image.

On the other hand, as described in the first embodiment, in the comparative conventional example shown in FIG. 5, the surface potential of the pertinent position, i.e., the area A, on the photosensitive drum 1 in the portion thereof wherein the transfer bias voltage has been rendered off when the trailing edge of the recording paper P for the first page passes the transferring nip part Nt is −320 volts, which is higher than the surface potential −300 volts of the other portions. Accordingly, if developing is intactly effected, an area low in density will occur to a halftone for the second page, as in the above-described comparative conventional example shown in FIG. 8.

Accordingly, in the second embodiment, during the print of the second page, when the position at which the transfer bias voltage has been stopped and made into 0V, i.e., the area A, has arrived at the developing position, the developing bias voltage (DC voltage) applied to the developing roller 4*a* is lowered in voltage value (made greater in the absolute value of voltage) from −450 volts to −460 volts (S-21 and S-22). By the absolute value of the developing bias voltage being made greater by 10 volts as described above, the halftone could be prevented from becoming low in density. Also, when the area A passes the developing position, the developing bias voltage is restored from −460 volts to −450 volts (S-23 and S-24).

Thereafter, the aforedescribed step S-03 and subsequent steps are executed to thereby continue image forming.

When an attempt was made to continuously print halftone images by the use of the image forming apparatus according to the second embodiment, neither the black line caused by the stripping discharge of the trailing edge of the recording paper P nor the low density portion of the halftone caused by the transfer bias voltage being rendered off near the trailing edge of the recording paper P occurred and good images could be obtained.

While in the above-described first and second embodiments, the density of the second and subsequent pages is corrected by the charging bias voltage or the developing bias voltage, this is not restrictive but for example, it is also possible to make the amount of laser exposure great to thereby keep the density constant when the aforedescribed area A passes an exposing position at which a laser 3 is applied onto the photosensitive drum 1.

Figure 11:
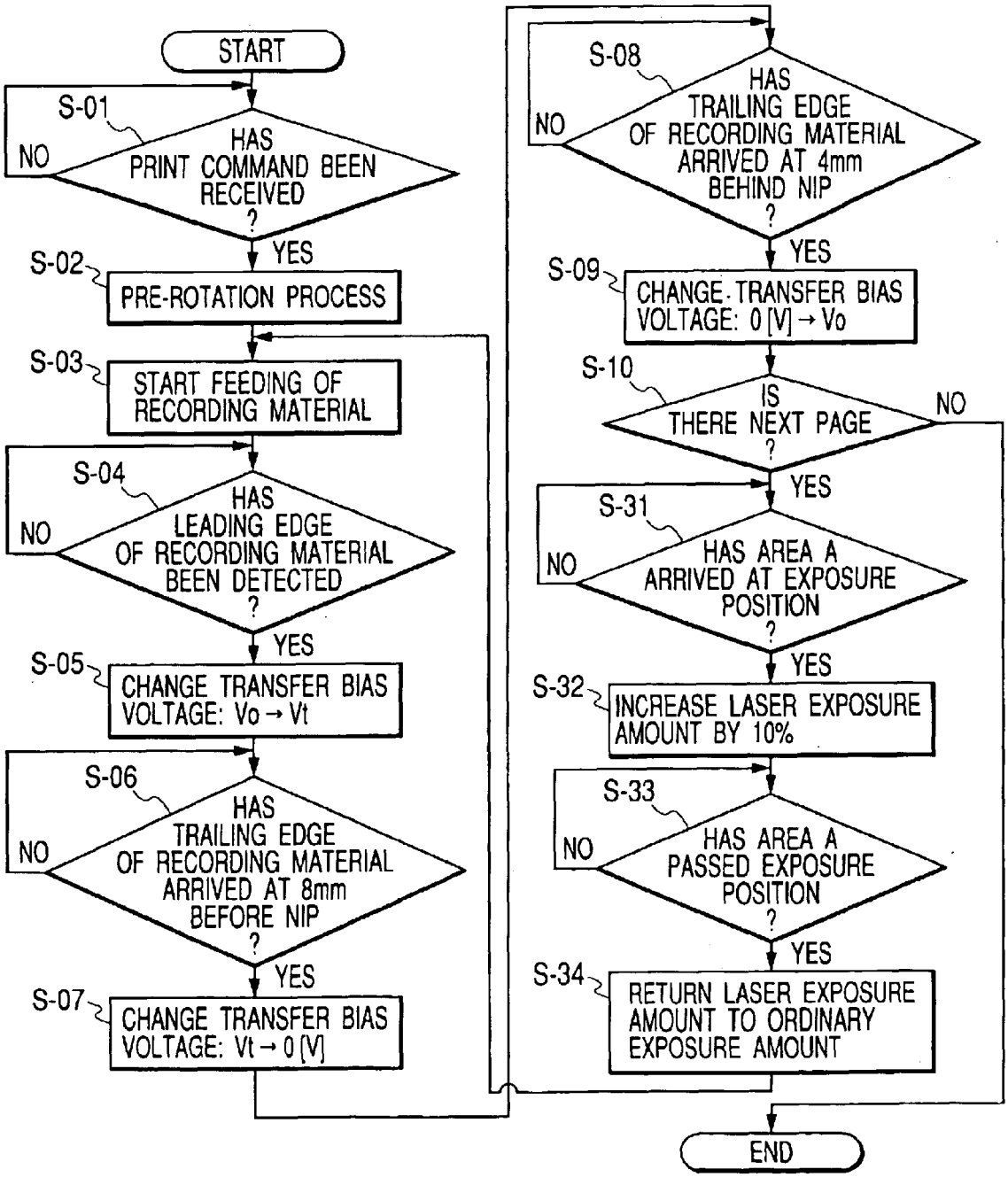
FIG. 11 is a flow chart for illustrating the operation mode when halftone images are printed on two sheets on end in accordance with a modification of the second embodiment.

What has been described above will be further described with reference to FIG. 11, but the differences of FIG. 11 from FIG. 9 are steps S-31 to S-34 and therefore, these steps S-31 to S-34 will hereinafter be described.

In a case where after a print command is received and the print of the first page is terminated (S-01 to S-09), the print of the next page is to be effected (YES at S-10), during the print of the second page, the laser exposure amount for the second page is increased from a normal exposure amount by 10% (S-31 and S-32) when the position at which the transfer bias voltage has been stopped and made into 0 V, i.e., the area A, has arrived-at the exposing position at which the laser 3 is applied onto the photosensitive drum 1. When the area A passes the exposing position, the laser exposure amount is restored to the normal exposure amount (S-33 and S-34). Thereby, the surface potential of the photosensitive drum 1 after the exposure of the second page could be kept constant at −300 volts and image density could be made constant at 0.9.

Thereafter, the step S-03 and subsequent steps are executed to thereby continue image forming.

By the laser exposure amount being appropriately controlled as described above, neither the black line caused by the discharge of the trailing edge of the recording paper P nor the low density portion of a halftone caused by the transfer bias voltage being stopped and made into 0 V near the trailing edge of the recording paper P occurred and good images could be obtained.

<Third Embodiment>

A third embodiment of the present invention will now be described. In the present embodiment, the construction of the image forming apparatus is similar to that of the image forming apparatus according to the first embodiment shown in FIG. 1.

The third embodiment differs from the aforedescribed-embodiments in that in order to obtain a more uniform image, design is made such that the transfer bias voltage is not be instantaneously stopped when the trailing edge of the recording paper P for the first page passes the transferring nip part Nt, but is gradually lowered for a time of the order of 30 msec. and then stopped. The present embodiment is further characterized in that in order to improve the uniformity of an image, the charging bias voltage is also gradually changed for a time of the order of 30 msec.

Figure 12:
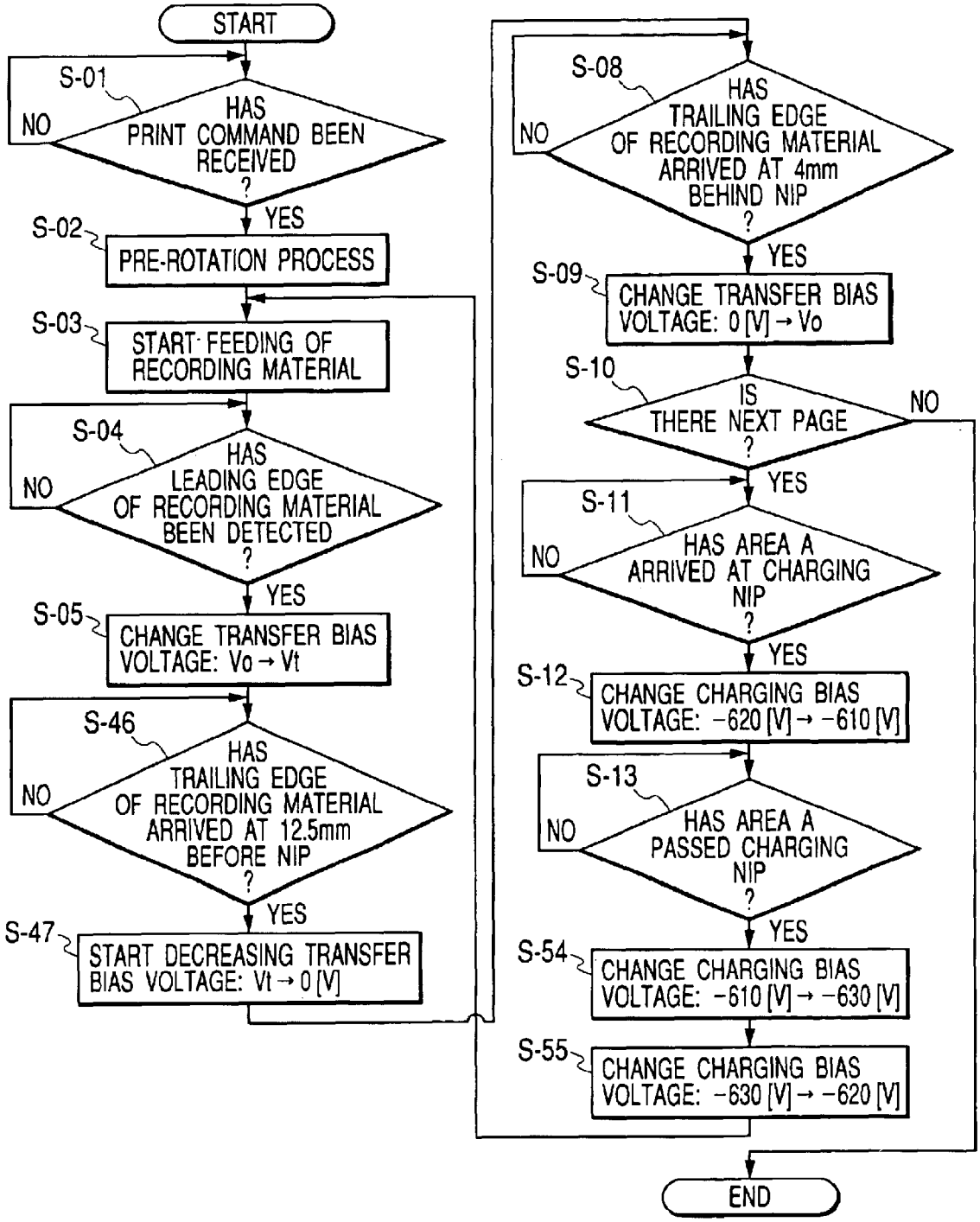
FIG. 12 is a flow chart for illustrating the operation mode when halftone images are printed on two sheets on end in accordance with a third embodiment.
Figure 13:
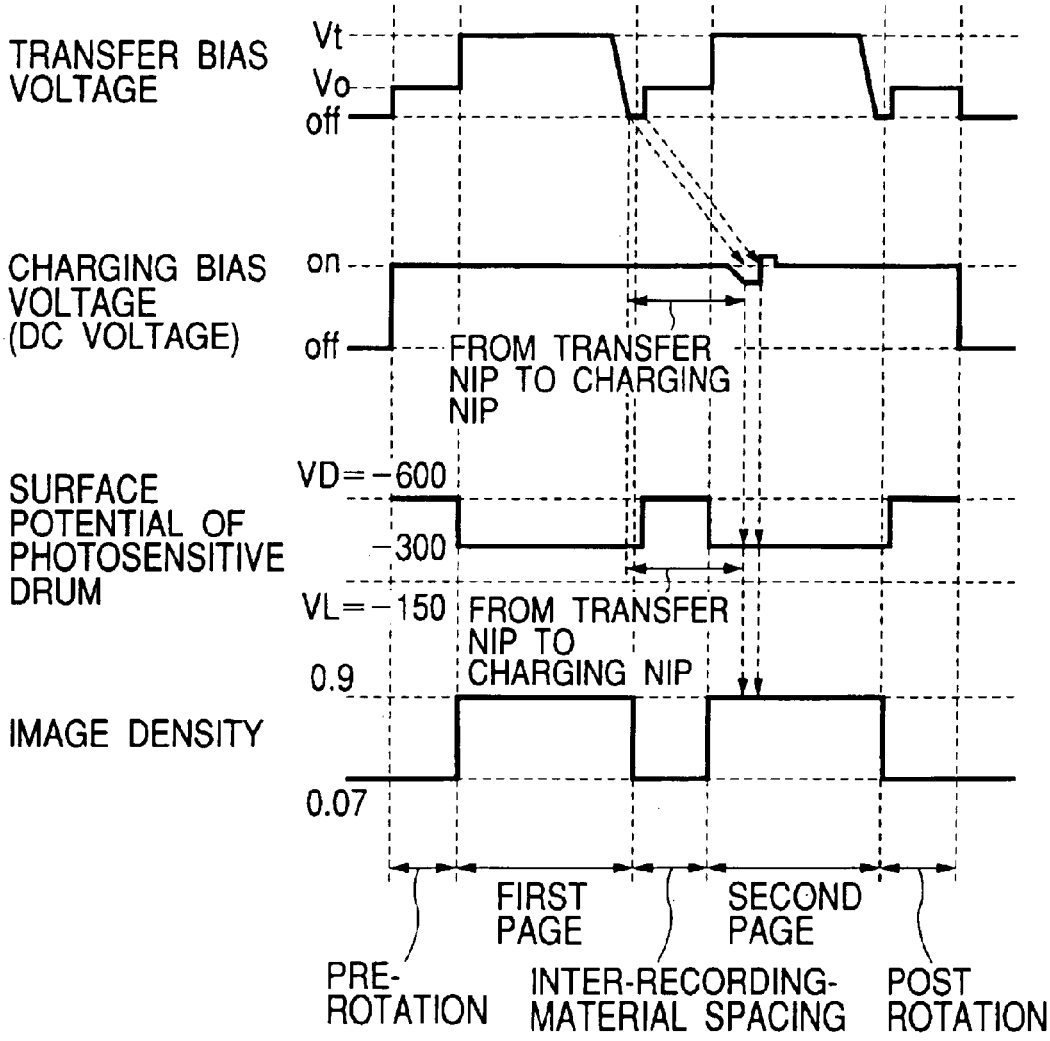
FIG. 13 is a timing chart showing a transfer bias, a charging DC voltage, photosensitive member potential and printed image density when halftone images are printed on two sheets on end in accordance with the third embodiment.

Reference is now had to FIGS. 12 and 13 to describe the third embodiment.

FIG. 12 is a flow chart for illustrating the operation mode when as in the first embodiment, halftone images are printed on two sheets on end in accordance with the third embodiment, and FIG. 13 is a timing chart showing a transfer bias voltage, a charging bias voltage (DC voltage), the surface potential of the photosensitive drum 1 and printed image density at that time. Again in the third embodiment, the photosensitive member is a cylindrical drum-shaped photosensitive drum 1, and is subjected to the steps of charging, exposing, developing, transferring and cleaning with the rotation thereof and therefore, the timing chart has some time differences at the respective steps, but here description will be made with the time differences neglected for simplicity.

The operations in the flow chart of FIG. 12 are operations executed by the video controller 103 and the engine controller 102 the control means 101 has. Particularly, the engine controller 102 transmits a control signal to the transfer bias controlling circuit 112 to thereby control the transfer bias voltage, and transmits a control signal to the primary charging bias controlling circuit 111 to thereby control the charging bias voltage.

According to the third embodiment, when print is started and a print command is received by the control means 101 of the apparatus main body, a pre-rotation process operation for starting the print is started (S-01 and S-02).

As will be understood from FIG. 13, when in the pre-rotation process, the pre-rotation operation for starting print is started, the transfer bias voltage is changed over from 0 V in a stopped state to the transfer voltage $V_0$ during the non-supply of paper. The transfer bias voltage $V_0$ during then non-supply of paper is applied on the basis of a value detected by a transfer current detecting portion (not shown) so that a transfer current amount flowing with the transfer voltage $V_0$ during the non-supply of paper applied may become constant, and the resistance value of the transferring roller is roughly calculated from the transfer bias voltage $V_0$ during the non-supply of paper to thereby determine the transfer bias voltage Vt during the supply of paper.

Also, the charging bias voltage (DC voltage) is rendered on to charge the surface of the photosensitive drum to predetermined potential when the pre-rotation is started. In the present embodiment, in order to obtain the charged potential −600 volts of the photosensitive member, the charging DC voltage was −620 volts. The potential of the photosensitive member becomes predetermined dark potential VD=−600 volts by the charging being on. When the print of the first page is started, the charging DC voltage remains on and is constant, but the potential of the photosensitive member is about −300 volts because the photosensitive member is subjected to exposure.

On the other hand, when the pre-rotation process is terminated, the recording paper P is taken out of the paper feeding cassette 26 by the paper feeding roller 22, and is fed to the registration rollers 24 (S-03). When the leading edge of the recording paper is detected by the top sensor 8 (S-04), the transfer bias controlling circuit 112 changes over the transfer bias voltage from the transfer bias voltage $V_0$ during the non-supply of paper to the transfer bias voltage Vt during the supply of paper to transfer the toner image developed on the photosensitive drum 1 to the recording paper P(S-05).

Again in the third embodiment, the transfer bias controlling circuit 112 controlled the transfer voltage $V_0$ during the non-supply of paper so that during the non-supply of paper, a transfer current of about 3 $\mu$A (microamperes) might flow to the photosensitive drum 1 through the transferring roller 5. The transfer bias voltage applied to the transferring roller 5 at this time is of the order of +700 V (volts).

On the other hand, the transfer bias controlling circuit 112 controls the transfer bias voltage during the supply of paper so as to assume a value converted from the transfer bias voltage $V_0$ (third transfer voltage) applied to the transferring roller 5 during the non-supply of paper. The transfer bias voltage Vt during the supply of paper (first transfer voltage) applied to the transferring roller 5 differs depending on the resistance value of the transferring roller 5 changed by the environment under which the printer apparatus main body 100 is place, but it is set so that under any environment, the transfer current flowing to the transferring roller 5 may be about 6 $\mu$A.

In order to prevent the photosensitive member memory caused by stripping discharge occurring when at the trailing edge of the first page, the trailing edge of the recording paper P is stripped of from the photosensitive drum 1, in the third embodiment, the transfer bias voltage began to be lowered when that portion of the recording paper P which was about 12.5 mm before the trailing edge of the recording paper passed the transferring nip part Nt, and the transfer bias voltage was made into 0 volt when that portion of the recording paper which was about 4.5 mm before the trailing edge of the paper passed the center of the transferring nip (S-46 and S-47). Thereafter, the transfer bias voltage is made into the transfer bias voltage $V_0$ during the non-supply of paper after the trailing edge of the paper has passed the transferring nip by 4 mm (S-08 and S-09).

Here, an area on the photosensitive drum 1 which has passed the transferring roller 5 at the steps S-07 to S-09 from after the transfer bias voltage has begun to be lowered until it is stopped is defined as the "area A".

Also, as regards judgement as to at what position the trailing edge of the recording paper P is, and at what position the "area A" is, as in the first embodiment, design is made such that the engine controller 102 has a counter for counting time, and the position of the recording paper and the position of the "area A" are judged from the time counted by the counter after the leading edge of the paper is detected by the top sensor 8.

As will be understood from FIG. 13, in an area corresponding to the inter-recording-material spacing, the transfer bias voltage is maintained at the transfer voltage $V_0$ during the non-supply of paper, and the charging DC voltage is on and is constant. The surface potential of the photosensitive drum 1 is dark potential VD because in the inter-recording-material spacing, the photosensitive drum is not subjected to exposure.

The control means 101 subsequently judges as to the necessity or unnecessariness of the print of the second page (S-10), and if the print of the second page is unnecessary, the image forming operation is terminated. If the print is necessary, shift is made to the printing operation for the second page.

Regarding the print of the second page, like that of the first page, the charging bias voltage (DC voltage) remains on and the surface potential of the photosensitive drum 1 is of the order of −300 volts because the photosensitive drum is subjected to exposure for a halftone image.

In the third embodiment, unlike the first embodiment, when the trailing edge of the recording paper P for the first page passed the transferring nip part Nt, at a point of time whereat the corresponding position on the photosensitive drum 1 which was at the transferring position until the transfer voltage was gradually made smaller and was stopped, i.e., the area A, had come to the charging position, the charging bias voltage normally of −620 volts had its absolute value gradually increased to −610 volts also for a time of 30 msec., and −610 volts was maintained for a time during which the position on the photosensitive drum 1 which passed the transferring nip part Nt when the application of the transfer bias voltage was stopped, i.e., the area A, passed the charging nip part Nd (S-11 and S-12).

In the third embodiment, design is made such that the charging bias voltage has its voltage value thereafter once lowered from −610 volts to −630 volts (has its absolute value made greater) and then restored to normal −620 volts (S-54 and S-55).

Thereafter, the aforedescribed step S-03 and subsequent steps are executed to thereby continue image forming.

Figure 14:
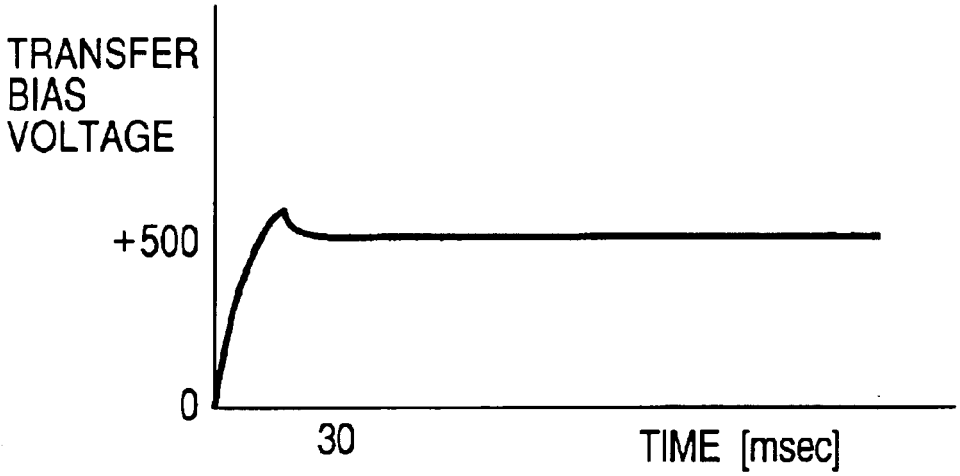
FIG. 14 is a graph for illustrating the rising of a transfer voltage.

In the third embodiment, as described above, the charging bias voltage is lowered to −630 volts and then is restored to normal −620 volts, and the reason for this is that the overshooting of the transfer bias voltage as shown in FIG. 14 may occur when the transfer bias voltage is changed from its stopped state to the transfer voltage $V_0$ during the non-supply of paper.

In the third embodiment, the transfer voltage $V_0$ during the non-supply of paper became stable after about 30 msec. elapsed after it instantaneously overshot to about +550 volts and then started rising until it became about +500 volts. In the image forming apparatus according to the third embodiment, the transport speed (process speed) when the recording paper P is transported to thereby effect image forming is 150 mm/sec. and therefore, 30 msec. corresponds to 4.5 mm in terms of the length of the recording paper P.

Figure 15:
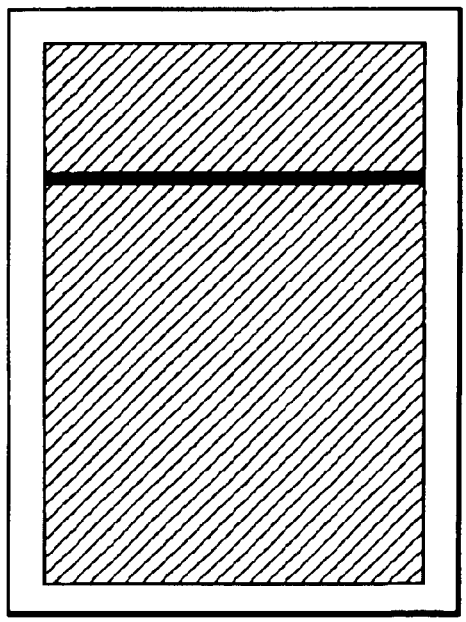
FIG. 15 shows a printed image in the comparative example.

When a halftone image was printed on the second page, if the charging bias voltage was not once made into −630 volts, the density of a portion subjected to the overshooting of the transfer bias voltage become somewhat high as shown in FIG. 15.

On the other hand, in the third embodiment, by incorporating the control as described above, a halftone image could be made uniform.

While in the foregoing, the density of the second and subsequent pages is corrected by the charging bias voltage, this is not restrictive, but for example, it is also possible to make the developing bias voltage low to thereby keep the density constant when the aforedescribed area A passes the developing roller 4*a*.

Figure 16:
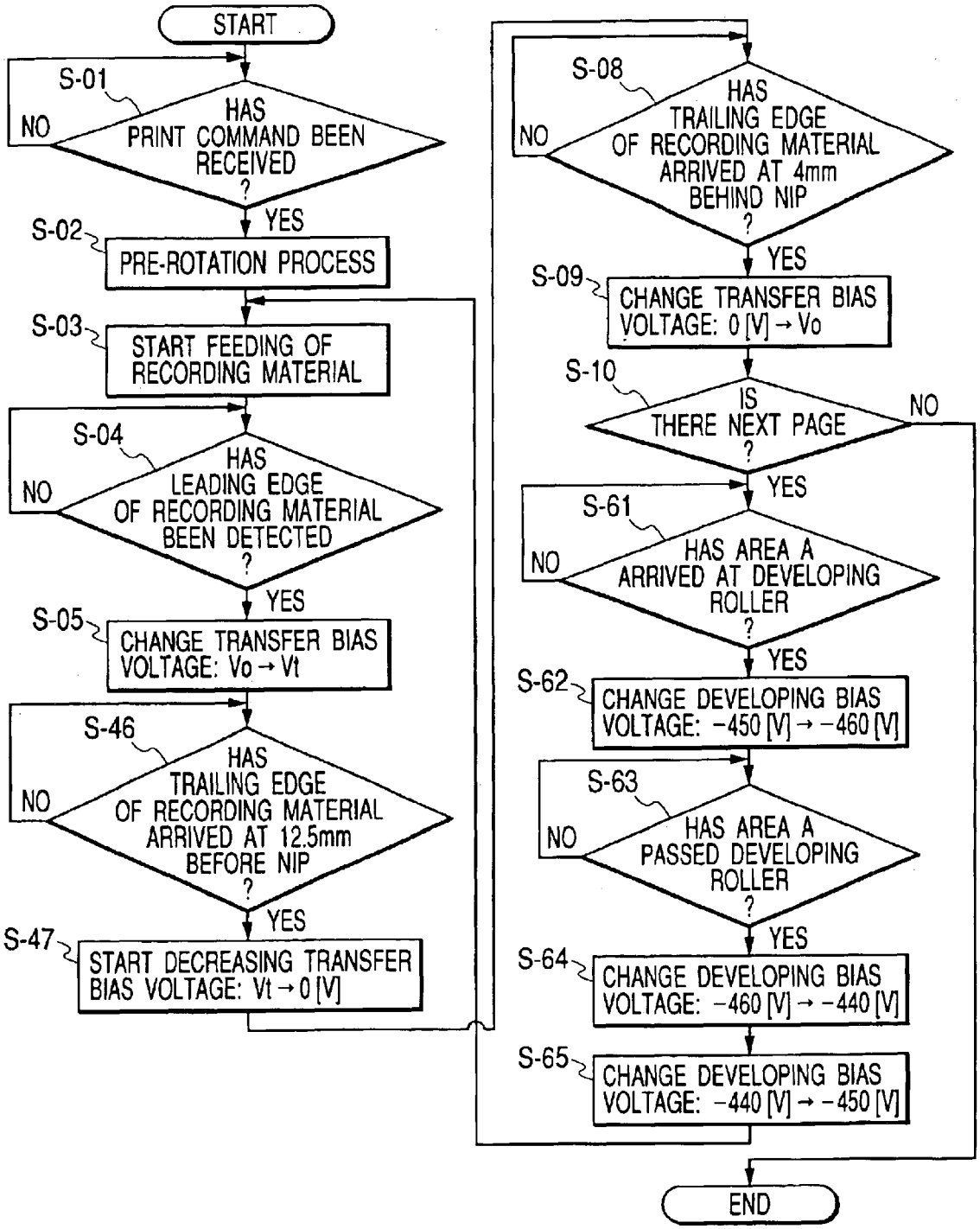
FIG. 16 is a flow chart for illustrating the operation mode when halftone images are printed on two sheets on end in accordance with a modification of the third embodiment.

What has been described above will be further described with reference to FIG. 15, but the differences of FIG. 16 from FIG. 12 are steps S-61 to S-65 and therefore, the steps S-61 to S-65 will hereinafter be described.

When the print of the next page is to be effected (YES at S-10) after a print command has been received and the print of the first page has been terminated (S-01 to S-09), that is, during the print of the second page, at a point of time whereat the aforedescribed area A came to the developing roller, the developing bias voltage normally of −450 volts had its voltage value gradually lowered (had its absolute value increased) to −460 volts also for a time of 30 msec., and −460 volts was maintained while the area A passed the developing roller 4*a* (S-61, S-62 and S-63).

In the third embodiment, design is made such that the developing bias voltage has its voltage value thereafter once heightened from −460 volts to −440 volts (has its absolute value made smaller) and then restored to normal −450 volts (S-64 and S-65).

Thereafter, the aforedescribed step S-03 and subsequent steps are executed to thereby continue image forming.

In the third embodiment, as described above, the developing bias voltage is made into −440 volts and then is restored to normal −450 volts, and the reason for this is that as previously described, the overshooting of the transfer bias voltage as shown in FIG. 14 may occur when the transfer bias voltage is changed from its stopped state to the transfer bias voltage $V_0$ during the non-supply of paper.

As described above, by the developing bias voltage being appropriately controlled, a halftone image could be made uniform.

<Fourth Embodiment>

A fourth embodiment of the present invention will now be described. In the present embodiment, the construction of the image forming apparatus is similar to that of the image forming apparatus according to the first embodiment shown in FIG. 1.

The fourth embodiment is characterized in that design is made such that in order to prevent the photosensitive member memory caused by discharge occurring when the trailing edge of the recording paper P for the first page separates from the photosensitive drum 1, when that portion of the paper which is about 8 mm before the trailing edge of the paper passes the transferring nip, the transfer bias voltage is once changed over to a minus transfer bias voltage, and the transfer bias voltage is stopped after the trailing edge of the recording paper P has passed the transferring nip part Nt by 2 mm, and further the transfer bias voltage $V_0$ during the non-supply of paper is rendered on after the trailing edge of the recording paper P has passed the transferring nip part Nt by 4 mm. In the fourth embodiment, the transfer bias voltage value of the negative polarity was set to the order of −1 to −2 kV.

The present embodiment will now be described with reference to FIGS. 17 and 18.

Figure 17:
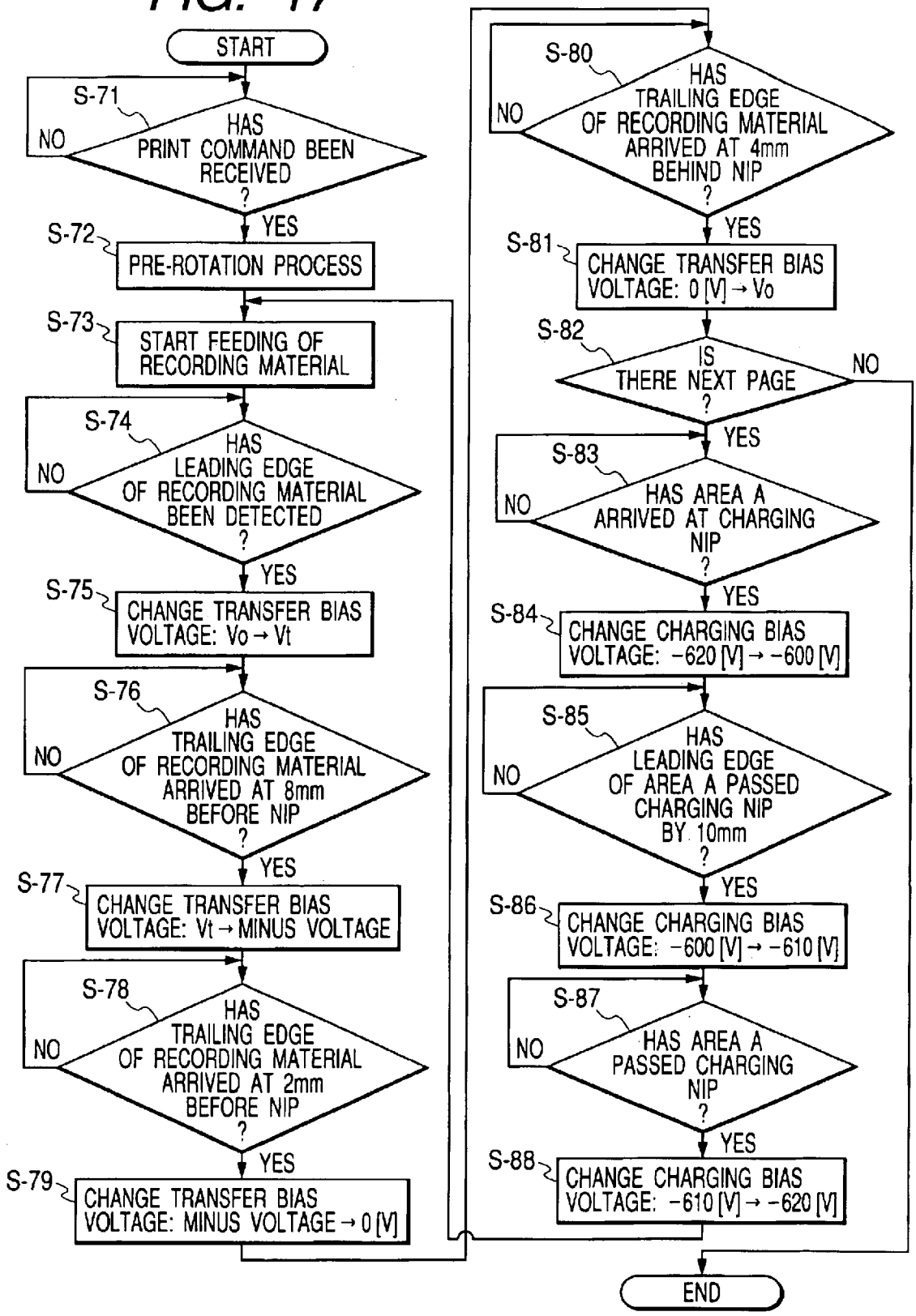
FIG. 17 is a flow chart for illustrating the operation mode when halftone images are printed on two sheets on end in accordance with a fourth embodiment.
Figure 18:
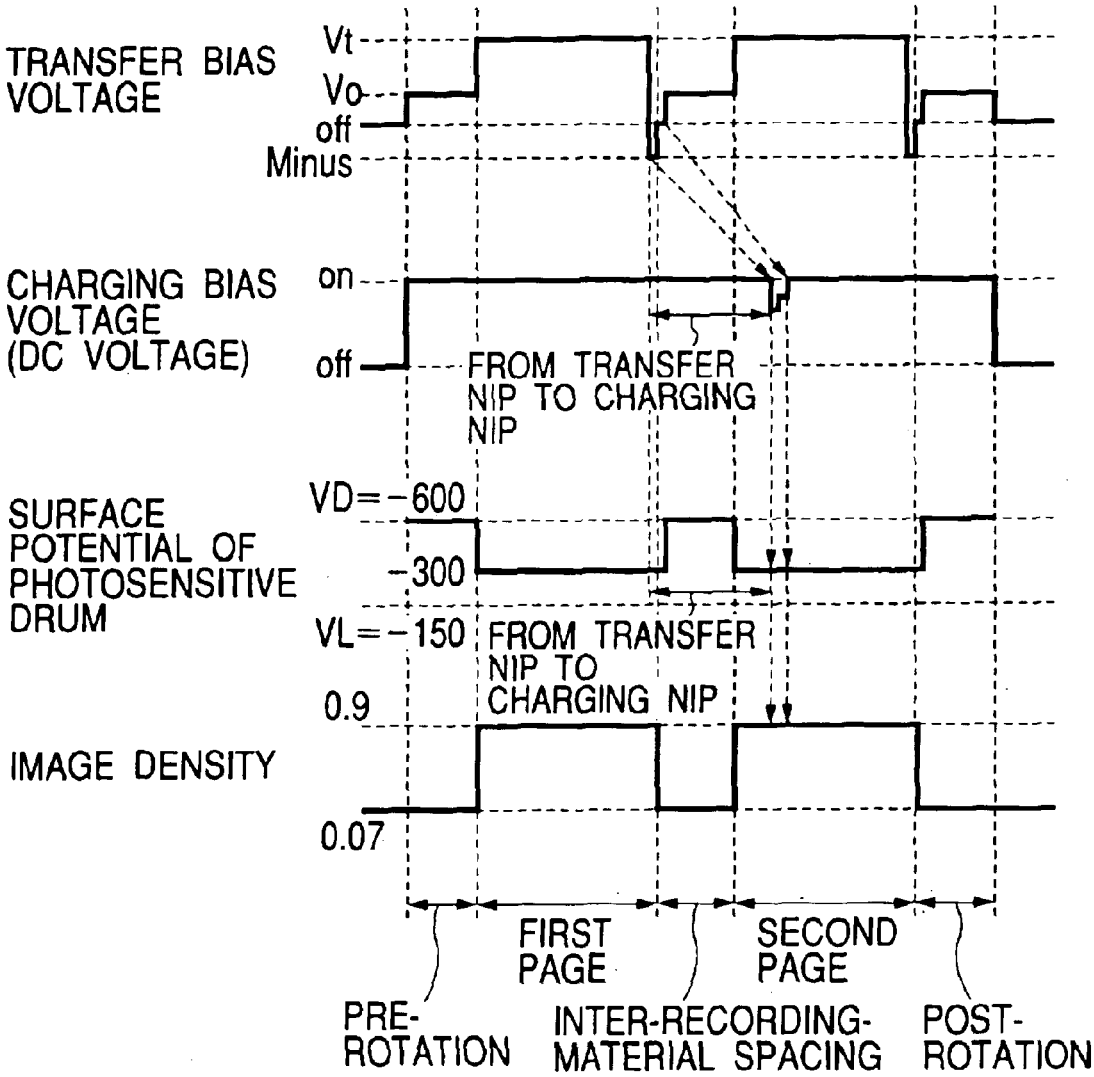
FIG. 18 is a timing chart showing a transfer bias, a charging DC voltage, photosensitive member potential and printed image density when halftone images are printed on two sheets on end in accordance with the fourth embodiment.

FIG. 17 is a flow chart for illustrating the operation mode when as in the first embodiment, halftone images are printed on two sheets on end in accordance with the fourth embodiment, and FIG. 18 is a timing chart showing a transfer bias, a charging DC voltage, photosensitive member potential and printed image density at that time. Again in the present embodiment, the photosensitive member is a cylindrical drum-shaped photosensitive drum 1, and with the rotation thereof, it is subjected to the steps of charging, exposing, developing, transferring and cleaning and therefore, the timing chart has some time differences at the respective steps, but here description will be made with the time differences neglected for simplicity.

The operations in the flow chart of FIG. 17 are operations executed by the video controller 103 and the engine controller 102 the control means 101 has. Particularly, the engine controller 102 transmits a control signal to the transfer bias controlling circuit 112 to, thereby control the transfer bias voltage, and transmits a control signal to the primary charging bias controlling circuit 111 to thereby control the charging bias voltage.

The portion of the pre-rotation operation for starting print is similar to that in the first embodiment.

That is, according to the fourth embodiment, when the print is started and a print command is received by the apparatus main body control means 101, the pre-rotation process operation for starting the print is started (S-71 and S-72).

As will be understood from FIG. 18, in the pre-rotation process, the transfer bias voltage is changed over from 0 V in its stopped state to the transfer voltage $V_0$ during the non-supply of paper. The transfer bias voltage $V_0$ during the non-supply of paper is applied on the basis of a value detected by a transfer current detecting portion (not shown) so that a transfer current amount flowing with the transfer voltage $V_0$ during the non-supply of paper applied may become constant, and the resistance value of the transferring roller is roughly calculated from the transfer bias voltage $V_0$ during the non-supply of paper to thereby determine the transfer bias voltage Vt during the supply of paper.

Also, the charging bias voltage (DC voltage) is rendered on to charge the surface of the photosensitive drum to predetermined potential when the pre-rotation is started. In the present embodiment, the charging DC voltage was −620 volts in order to obtain the charged potential −600 volts of the photosensitive member. The potential of the photosensitive member becomes predetermined dark potential VD=−600 volts by charging on. When the print of the first page is started, the charging DC voltage remains on and is constant, but the potential of the photosensitive member is about −300 volts because the photosensitive member is subjected to exposure.

On the other hand, when the pre-rotation process is terminated, the recording paper P is taken out of the paper feeding cassette 26 by the paper feeding roller 22 and is fed to the registration rollers 24 (S-73). When the leading edge of the recording paper is detected by the top sensor 8 (S-74), the transfer bias controlling circuit 112 changes over the transfer bias voltage from the transfer bias voltage $V_0$ during the non-supply of paper to the transfer bias voltage Vt during the supply of paper to transfer the toner image developed on the photosensitive drum 1 to the recording paper P (S-75).

In the fourth embodiment, the transfer bias controlling circuit 112 controlled the transfer voltage $V_0$ during the non-supply of paper so that during the non-supply of paper, a transfer current of about 3 $\mu$A (microamperes) might flow to the photosensitive drum 1 through the transferring roller 5. The transfer bias voltage applied to the transferring roller 5 at this time is of the order of +700 V (volts).

On the other hand, the transfer bias controlling circuit 112 controls the transfer bias voltage during the supply of paper so as to assume a value converted from the transfer bias voltage $V_0$ (third transfer voltage) applied to the transferring roller 5 during the non-supply of paper. The transfer bias voltage Vt during the supply of paper (first transfer voltage) applied to the transferring roller 5 differs depending on the resistance value of the transferring roller 5 changed by the environment under which the printer apparatus main body 100 is placed, but it is set so that under any environment, the transfer current flowing to the transferring roller 5 may be about 6 $\mu$A.

As described above, in the fourth embodiment, in order to prevent the photosensitive member memory caused by stripping discharge occurring when at the trailing edge of the first page, the trailing edge of the recording paper P is stripped off from the photosensitive drum 1, and the transfer bias is once changed over to a minus voltage when that portion of the recording paper P which is about 8 mm before the trailing edge of the recording paper passes the transferring nip part Nt, and the transfer bias is stopped after the trailing edge of the paper has passed the transferring nip by 2 mm, and further it is made into the transfer bias voltage $V_0$ during the non-supply of paper after the trailing edge of the recording paper P has passed the transferring nip part Nt by 4 mm (S-76, S-77, S-78, S-79, S-80 and S-81). In the fourth embodiment, the minus voltage value was set to the order of −1 to −2 kV.

Here, an area on the photosensitive drum 1 which passed the transferring roller 5 when at the steps S-78 to S-80, the transfer bias voltage was stopped and the transfer bias voltage value was a negative value is defined as an "area A".

Also, as regards the judgment as to at what position the trailing edge of the recording paper P is and at what position the "area A" is, design is made such that as in the first embodiment, the engine controller 102 has a counter for counting time, and the position of the recording paper and the position of the "area A" are judged from the time counted by the counter after the leading edge of the paper has been detected by the top sensor 8.

Thereafter, in an area corresponding to the inter-recording-material spacing, the transfer bias voltage maintains the transfer voltage $V_0$ during the non-supply of paper, and the charging bias voltage is on and is constant. The surface potential of the photosensitive drum 1 is dark potential VD because in the inter-recording-material spacing, the photosensitive drum is not subjected to exposure.

The control means 101 subsequently judges about the necessity or unnecessary of the print of the second page (S-82), and if the print of the second page is unnecessary, the image forming operation is terminated. If the print is necessary, shift is made to the printing operation for the second page.

Regarding the print of the second page, like the print of the first page, the charging bias voltage (DC voltage) remains on, and the surface potential of the photosensitive drum 1 is of the order of −300 volts because the photosensitive drum 1 is subjected to exposure for a halftone image.

Figure 19:
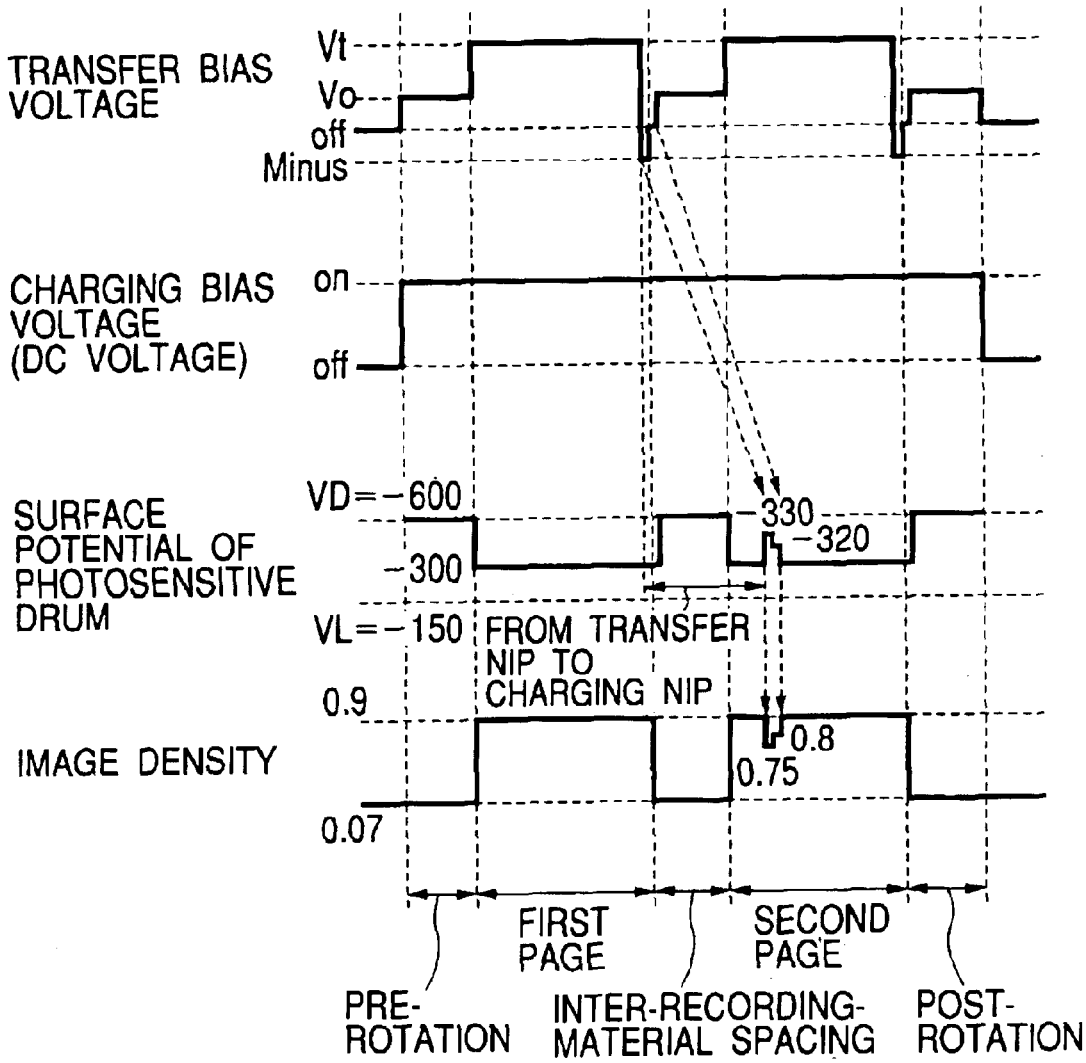
FIG. 19 is a timing chart showing a transfer bias, a charging DC voltage, photosensitive member potential and printed image density when halftone images are printed on two sheets on end in the comparative conventional example.

FIG. 19 is a timing chart showing a transfer bias, a charging bias voltage, the surface potential of the photosensitive drum and printed image density in the comparative conventional example. In the comparative conventional example, the surface potential of the photosensitive drum 1 in that portion thereof wherein at the trailing edge of the recording paper P for the first page, the transfer bias voltage was made into a minus voltage is −330 volts, and the surface potential of the photosensitive drum in that portion thereof wherein the transfer bias voltage was stopped and rendered into 0V is −320 volts, thus being lower than the potential −300 volts of the other portions. Therefore, as regards the image density, halftone density is low in each of the above-described pertinent portions, that is, in the minus pertinent portion, it is 0.75 (a value by a Macbeth density meter), and in the off pertinent portion, it is 0.8. On the other hand, the halftone density of the other portions was 0.9.

As described above, in the comparative conventional example, there was seen a density difference of halftone in the second and subsequent continuously printed sheets, i.e., the tendency of the image density of halftone becoming lower in the pertinent portions.

So, in the present embodiment, as shown in FIG. 18, during the print of the second page, the charging bias voltage for the second page is raised from normal −620 volts to −600 volts when a position at which the transfer bias was made minus has come to the charging position, and the absolute value thereof is made smaller from normal −620 volts to −610 volts when a position at which the transfer bias voltage was stopped and rendered into 0 V has come to the charging nip part Nd.

That is, in the fourth embodiment, as shown in FIG. 17, during the print of the second page, the charging bias voltage for the second page has its voltage value made higher (has its absolute value made smaller) from normal −620 volts to −600 volts when the position at which the transfer bias voltage was made minus, i.e., the area A, has arrived at the charging nip part Nd in which the primary charging roller 2 is disposed (S-83 and S-84), and has its voltage value made lower (has its absolute value made greater) from −600 volts to −610 volts at a point of time whereat the leading edge of the area A has passed the charging nip by 10 mm, i.e., the position at which the transfer bias voltage was stopped and rendered into 0 V (S-85 and S-86). Also, when the area A passes the charging nip part Nd, the charging bias voltage is restored from −610 volts to normal −620 volts (S-87 and S-88). Thereby, the surface potential of the photosensitive drum 1 after the exposure of the second page could be made constant at −300 volts and the image density could be made constant at 0.9.

Thereafter, the aforedescribed step S-73 and subsequent steps are executed to thereby continue image forming.

In the fourth embodiment, it is more effective to prevent the black line caused by the stripping discharge at the trailing edge of the recording paper P that the minus transfer bias voltage is once applied at the trailing edge of the recording paper P, but it has suffered from the tendency that the band of the low density of the halftone on the next page is more conspicuous. In the present embodiment, the unevenness of the halftone and the black line could be prevented by correcting the charging bias voltage.

Also, while in the fourth embodiment, the minus voltage was applied when the trailing edge of the recording paper P passed the transferring nip part Nt by 2 mm, and the transfer bias voltage $V_0$ of the positive polarity during the non-supply of paper was applied when the trailing edge passed the transferring nip part Nt by 4 mm, there was no problem in particular even if the minus voltage was immediately changed over to the transfer bias voltage $V_0$ of the positive polarity during the non-supply of paper when the trailing edge of the recording paper P passed the transferring nip part Nt, and an effect was likewise obtained.

While in the foregoing, the density of the second and subsequent pages is corrected by the charging bias voltage, this is not restrictive, but it is also possible to lower the developing bias to thereby keep the density constant when for example, the aforedescribed area A passes the developing roller 4*a*.

Figure 20:
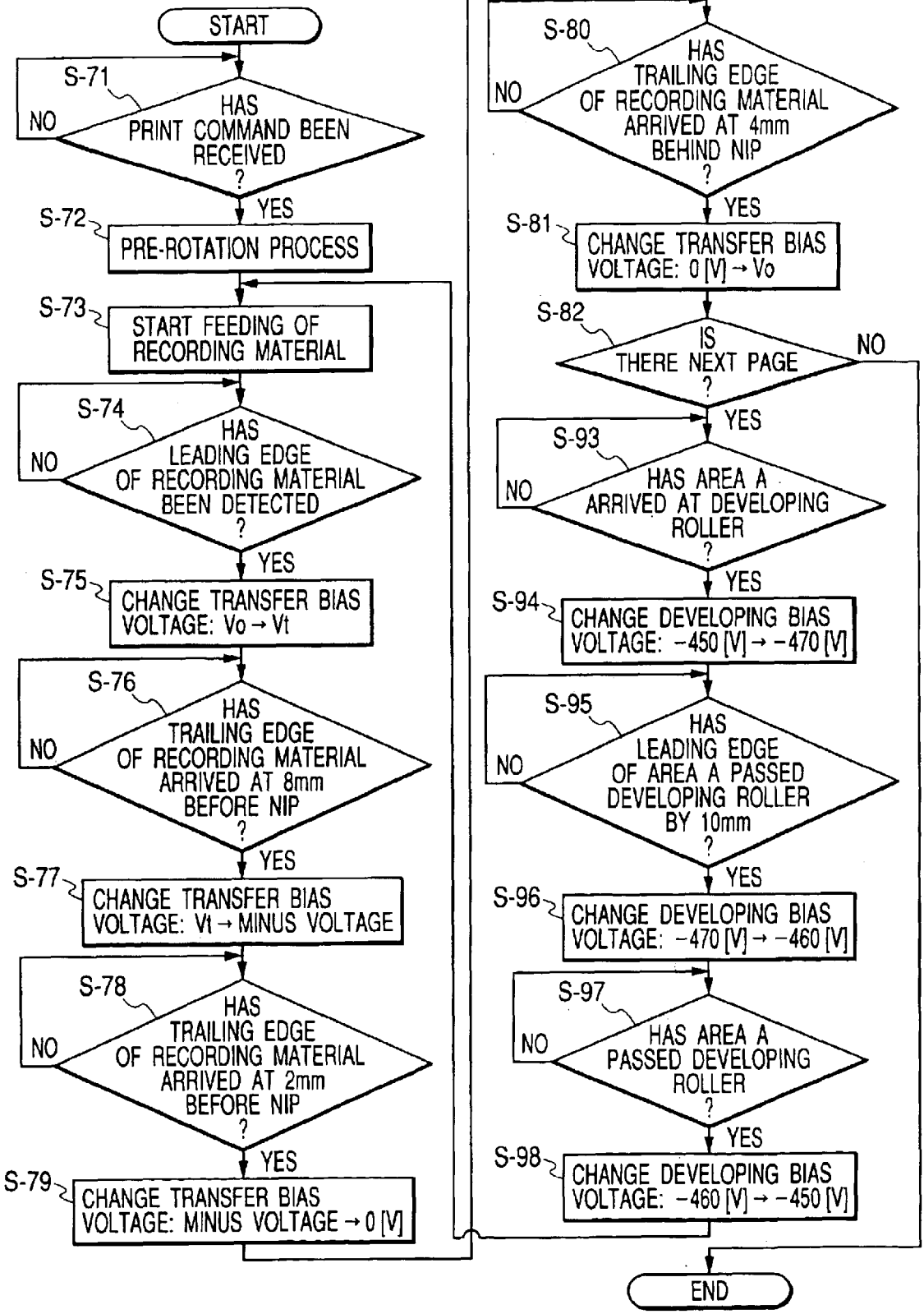
FIG. 20 is a flow chart for illustrating the operation mode when halftone images are printed on two sheets on end in accordance with a modification of the fourth embodiment.

What has been described above will be further described with reference to FIG. 20, but the differences of FIG. 20 from FIG. 17 are steps S-93 to S-98 and therefore, the steps S-93 to S-98 will be described below.

In a case where a print command is received and the print of the first page is terminated (S-71 to S-81), whereafter the print of the next page is to be effected (YES at S-82), during the print of the second page, the developing bias voltage (DC voltage) for the second page has its voltage value made lower (has its absolute value made greater) from normal −450 volts to −470 volts when the position at which the transfer bias voltage was made into a minus voltage, i.e., the area A, has arrived at the developing roller 4*a* (S-93 and S-94), and has its voltage value made higher (has its absolute value made smaller) from −470 volts to −460 volts at a point of time whereat the leading edge of the area A has passed the developing roller 4*a* by 10 mm, that is, at a position whereat the transfer bias voltage was stopped and made into 0 V (S-95 and S-96). Also, when the area A passes the developing roller 4*a,* the developing bias voltage is restored from −460 volts to normal −450 volts (S-97 and S-98). Thereby, the potential of the photosensitive member after the exposure of the second page could be made constant at −300 volts and the image density could be made constant at 0.9.

Thereafter, the aforedescribed step S-73 and subsequent steps are executed to thereby continue image forming.

By the developing bias voltage being appropriately controlled as described above, the unevenness of the halftone and the black line could be prevented.

The present invention is not restricted to the above-described embodiments, but of course, various modifications are possible within the scope of the appended claims.

What is claimed is:

1. An image forming apparatus comprising:

an image bearing member, which bears a toner image;

a charging member to which a charging voltage is applied to charge said image bearing member;

a transfer member to which a first transfer voltage of a polarity opposite to a polarity of the charging voltage is applied to transfer the toner image on said image bearing member to a recording material at a transfer position; and a controlling portion for controlling a voltage applied to said transfer member, wherein said controlling portion changes the voltage applied to said transfer member from said first transfer voltage to 0 V before a trailing edge of the recording material passes said transfer position, and thereafter changes the voltage to a second transfer voltage after the trailing edge of the recording material passes said transfer position, said second transfer voltage having the same polarity as said first transfer voltage, and an absolute value of a voltage value of said second transfer voltage being smaller than an absolute value of a voltage value of said first transfer voltage.

2. An image forming apparatus comprising:

an image bearing member, which bears a toner image;

a charging member to which a charging voltage is applied to charge said image bearing member;

a transfer member to which a first transfer voltage of a polarity opposite to a polarity of the charging voltage is applied to transfer the toner image on said image bearing member to a recording material at a transfer position; and a controlling portion for controlling a voltage applied to said transfer member, wherein said controlling portion turns off said first transfer voltage applied to said transfer member before a trailing edge of the recording material passes said transfer position, and applies a second transfer voltage to said transfer member after the trailing edge of the recording material passes said transfer position, said second transfer voltage having the same polarity as said first transfer voltage, and an absolute value of a voltage value of said second transfer voltage being smalller than an absolute value of a voltage value of said first transfer voltage.

3. An image forming apparatus comprising:

a movable image bearing member, which bears a toner image;

a charging member to which a charging voltage is applied to charge said image bearing member;

a transfer member to which a first transfer voltage of a polarity opposite to a polarity of the charging voltage is applied to transfer the toner image on said image bearing member to a recording material at a transfer position; and a controlling portion for controlling a voltage applied to said transfer member and the charging voltage applied to said charging member, wherein said controlling portion changes the voltage applied to said transfer member from said first transfer voltage to a second transfer voltage before a trailing edge of the recording material passes said transfer position, and thereafter changes the voltage to a third transfer voltage after the trailing edge of the recording material passes said transfer position, and said controlling portion makes a first charging voltage of the charging voltage when an area, to which said first transfer voltage is applied, on said image bearing member opposes said charging member, and makes a second charging voltage of the charging voltage when an area, to which said second transfer voltage is applied, on said image bearing member opposes said charging member, an absolute value of a voltage value of said second charging voltage being smaller than an absolute value of a voltage value of said first charging voltage, and a voltage value of said third transfer voltage being between a voltage value of said first transfer voltage and a voltage value of said second transfer voltage.

4. An image forming apparatus comprising:

a movable image bearing member, which bears a toner image;

a charging member to which a charging voltage is applied to charge said image bearing member;

a developing member to which a developing voltage having the same polarity as the charging voltage is applied to form the toner image on said image bearing member;

a transfer member to which a first transfer voltage of a polarity opposite to a polarity of the charging voltage is applied to transfer the toner image on said image bearing member to a recording material at a transfer position; and a controlling portion for controlling a voltage applied to said transfer member and the developing voltage, wherein said controlling portion changes the voltage applied to said transfer member from said first transfer voltage to a second transfer voltage before a trailing edge of the recording material passes said transfer position, and thereafter changes the voltage to a third transfer voltage after the trailing edge of the recording material passes said transfer position, and said controlling portion makes a first developing voltage of the developing voltage when an area, to which said first transfer voltage is applied, on said image bearing member opposes said developing member, and makes a second developing voltage of the developing voltage when an area, to which said second transfer voltage is applied, on said image bearing member opposes said developing member, an absolute value of a voltage value of said second developing voltage being larger than an absolute value of a voltage of said first developing voltage, and a voltage value of said third transfer voltage being between a voltage value of said first transfer voltage and a voltage value of said second transfer voltage.

5. An image forming apparatus according to claim 3 or 4, wherein the voltage value of said second transfer voltage is 0 V.

6. An image forming apparatus according to claim 3 or 4, wherein said second transfer voltage has the same polarity as the charging voltage.

7. An image forming apparatus comprising:

a movable image bearing member, which bears a toner image;

a charging member to which a charging voltage is applied to charge said image bearing member;

a transfer member to which a first transfer voltage of a polarity opposite to a polarity of the charging voltage is applied to transfer the toner image on said image bearing member to a recording material at a transfer position; and a controlling portion for controlling a voltage applied to said transfer member and the charging voltage applied to said charging member, wherein said controlling portion turns off said first transfer voltage applied to said transfer member before a trailing edge of the recording material passes said transfer position, and applies a second transfer voltage to said transfer member after the trailing edge of the recording material passes said transfer position, and said controlling portion makes a first charging voltage of the charging voltage when an area, to which said first transfer voltage is applied, on said image bearing member opposes said charging member, and makes a second charging voltage of the charging voltage when an area, to which a transfer voltage is not applied, between the area to which said first transfer voltage is applied and an area to which said second transfer voltage is applied, on said image bearing member opposes said charging member, an absolute value of a voltage value of said second charging voltage being smaller than an absolute value of a voltage value of said first charging voltage, said second transfer voltage having the same polarity as said first transfer voltage, and an absolute value of a voltage value of said second transfer voltage being smaller than an absolute value of a voltage value of said first transfer voltage.

8. An image forming apparatus comprising:

a movable image bearing member, which bears a toner image;

a charging member to which a charging voltage is applied to charge said image bearing member;

a developing member to which a developing voltage having the same polarity as the charging voltage to form the toner image on said image bearing member; a transfer member to which a first transfer voltage of a polarity opposite to a polarity of the charging voltage is applied to transfer the toner image on said image bearing member to a recording material at a transfer position; and a controlling portion for controlling a transfer voltage applied to said transfer member and the developing voltage applied to said developing member, wherein said controlling portion turns off said first transfer voltage applied to said transfer member before a trailing edge of the recording material passes said transfer position, and applies a second transfer voltage to said transfer member after the trailing edge of the recording material passes said transfer position, and said controlling portion makes a first developing voltage of the developing voltage when an area, to which said first transfer voltage is applied, on said image bearing member opposes said developing member, and makes a second developing voltage of the developing voltage when an area, to which a transfer voltage is not applied, between the area to which said first transfer voltage is applied and an area to which said second transfer voltage is applied, on said image bearing member opposes said developing member, an absolute value of a voltage value of said second developing voltage being smaller than an absolute value of a voltage value of said first developing voltage, said second transfer voltage having the same polarity as said first transfer voltage, and an absolute value of a voltage value of said second transfer voltage being smaller than an absolute value of a voltage value of said first transfer voltage.

9. An image forming apparatus comprising:

an image bearing member, which bears a toner image;

a charging member to which a charging voltage is applied to charge said image bearing member;

a transfer member to which a first transfer voltage of a polarity opposite to a polarity of the charging voltage is applied to transfer the toner image on said image bearing member to a recording material at a transfer position; and a controlling portion for controlling a voltage applied to said transfer member, wherein said controlling portion changes, regardless of whether the recording material is a front side or a backside, the voltage applied to said transfer member from said first transfer voltage to a second transfer voltage before a trailing edge of the recording material passes said transfer position, and thereafter changes the voltage to a third transfer voltage after the trailing edge of the recording material passes said transfer position, a voltage value of said third transfer voltage being between a voltage value of said first transfer voltage and a voltage value of said second transfer voltage.

* * * * *

UNITED STATES PATENT AND TRADEMARK OFFICE

CERTIFICATE OF CORRECTION

PATENT NO. : 6,965,742 B2
DATED : November 15, 2005
INVENTOR(S) : Toshio Miyamoto et al.

It is certified that error appears in the above-identified patent and that said Letters Patent is hereby corrected as shown below:

Column 4,
Line 48, “as” should read -- a --.

Column 8,
Line 2, “the-transferring” should read -- the transferring --.

Column 12,
Line 9, “arrived-at” should read -- arrived at --.

Column 13,
Line 39, “controlled” should read -- controls --.
Line 54, “place,” should read -- placed, --.

Column 17,
Line 58, “unnecessary” should read -- non-necessity --.

Column 21,
Line 22, “voltage” should read -- voltage value --.

Signed and Sealed this

Eleventh Day of April, 2006

JON W. DUDAS
*Director of the United States Patent and Trademark Office*